US008692755B2

(12) United States Patent
Barnhoefer et al.

(10) Patent No.: US 8,692,755 B2
(45) Date of Patent: Apr. 8, 2014

(54) GAMMA-CORRECTION TECHNIQUE FOR VIDEO PLAYBACK

(75) Inventors: Ulrich T. Barnhoefer, Sunnyvale, CA (US); Wei H. Yao, Fremont, CA (US); Wei Chen, Palo Alto, CA (US); Barry J. Corlett, Brisbane, CA (US); Jean-Didier Allegrucci, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 968 days.

(21) Appl. No.: 12/145,176

(22) Filed: Jun. 24, 2008

(65) Prior Publication Data

US 2009/0002555 A1 Jan. 1, 2009

Related U.S. Application Data

(60) Provisional application No. 61/016,092, filed on Dec. 21, 2007, provisional application No. 61/016,100, filed on Dec. 21, 2007, provisional application No. 60/946,270, filed on Jun. 26, 2007.

(51) Int. Cl.
*G09G 3/36* (2006.01)

(52) U.S. Cl.
USPC ..... 345/89; 345/102

(58) Field of Classification Search
USPC ..... 345/87, 102, 89
See application file for complete search history.

(56) References Cited

U.S. PATENT DOCUMENTS 5,717,422 A 2/1998 Fergason
5,758,091 A 5/1998 Hannah
5,808,697 A 9/1998 Fujimura et al.
5,930,402 A 7/1999 Kim
5,967,636 A 10/1999 Stark et al.
6,097,849 A 8/2000 Nevis (Continued)

FOREIGN PATENT DOCUMENTS

CN 1155807 A 7/1997
CN 1665298 A 9/2005

(Continued)

OTHER PUBLICATIONS

Kerofsky, Louis et al., "26.2: Distinguished paper: Brightness Preservation for LCD Backlight Reduction", Sharp Laboratories of America Camas, Washington, USA, 1242. SID 06 Digest.

(Continued)

*Primary Examiner* — Jonathan Boyd
(74) *Attorney, Agent, or Firm* — Fletcher Yoder PC

(57) ABSTRACT

Embodiments of a system that includes one or more integrated circuits are described. During operation, the system transforms the video image from an initial brightness domain to a linear brightness domain, which includes a range of brightness values corresponding to substantially equidistant adjacent radiant-power values in a displayed video image. In this linear brightness domain, the system may determine an intensity setting of the light source based on at least a portion of the transformed video image, such as the portion of the transformed video image that includes spatially varying visual information in the video image. Moreover, the system may modify the transformed video image so that a product of the intensity setting and a transmittance associated with the modified video image approximately equals a product of a previous intensity setting and a transmittance associated with the video image. For example, the modification may include changing brightness values in the transformed video image.

20 Claims, 23 Drawing Sheets

(56) References Cited

U.S. PATENT DOCUMENTS

| | | | | |
|---|---|---|---|---|
| 6,151,004 | A | 11/2000 | Kaneko | |
| 6,300,931 | B1 | 10/2001 | Someya | |
| 6,781,595 | B2 | 8/2004 | Kobayashi et al. | |
| 7,003,153 | B1 | 2/2006 | Kerofsky | |
| 7,102,697 | B2 | 9/2006 | Lei et al. | |
| 7,167,214 | B2 | 1/2007 | Hirosue | |
| 7,317,502 | B2 | 1/2008 | Hu et al. | |
| 7,403,318 | B2 | 7/2008 | Miyazawa et al. | |
| 7,454,137 | B2 | 11/2008 | Lee et al. | |
| 7,489,374 | B2 | 2/2009 | Utsumi et al. | |
| 7,592,996 | B2 | 9/2009 | Brown Elliott et al. | |
| 7,684,096 | B2 | 3/2010 | Gonsalves | |
| 7,796,143 | B2 | 9/2010 | Huang | |
| 2002/0021292 | A1 | 2/2002 | Sakashita | |
| 2002/0063702 | A1 | 5/2002 | Wada et al. | |
| 2002/0101432 | A1 | 8/2002 | Ohara et al. | |
| 2002/0110282 | A1 | 8/2002 | Kraft et al. | |
| 2002/0126134 | A1 | 9/2002 | Willis et al. | |
| 2003/0053690 | A1 | 3/2003 | Trifonov et al. | |
| 2003/0112378 | A1 | 6/2003 | Okunuki et al. | |
| 2003/0201968 | A1 | 10/2003 | Itoh | |
| 2004/0113906 | A1* | 6/2004 | Lew et al. | 345/211 |
| 2004/0257324 | A1 | 12/2004 | Hsu | |
| 2005/0093795 | A1 | 5/2005 | Lin et al. | |
| 2005/0179706 | A1 | 8/2005 | Childers | |
| 2005/0184952 | A1 | 8/2005 | Konno et al. | |
| 2005/0195298 | A1 | 9/2005 | Byun et al. | |
| 2006/0119612 | A1 | 6/2006 | Kerofsky et al. | |
| 2006/0139270 | A1 | 6/2006 | Hong et al. | |
| 2006/0146003 | A1 | 7/2006 | Diefenbaugh | |
| 2006/0146351 | A1 | 7/2006 | Lo et al. | |
| 2006/0221046 | A1 | 10/2006 | Sato | |
| 2006/0221326 | A1 | 10/2006 | Cok et al. | |
| 2006/0262111 | A1 | 11/2006 | Kerofsky | |
| 2006/0268180 | A1 | 11/2006 | Chou | |
| 2007/0040797 | A1 | 2/2007 | Shih et al. | |
| 2007/0097058 | A1 | 5/2007 | Kim et al. | |
| 2007/0109313 | A1 | 5/2007 | Jo | |
| 2007/0200811 | A1 | 8/2007 | So | |
| 2007/0268235 | A1 | 11/2007 | Estevez et al. | |
| 2007/0279372 | A1 | 12/2007 | Brown Elliott et al. | |
| 2008/0007655 | A1 | 1/2008 | Fujisawa et al. | |
| 2008/0018800 | A1 | 1/2008 | Kodavalla | |
| 2008/0074381 | A1 | 3/2008 | Kumamoto | |
| 2008/0204396 | A1 | 8/2008 | Otome | |
| 2008/0238840 | A1 | 10/2008 | Raman et al. | |
| 2009/0146941 | A1 | 6/2009 | Fujine et al. | |

FOREIGN PATENT DOCUMENTS

| | | | |
|---|---|---|---|
| CN | 1797533 | A | 7/2006 |
| EP | 0675645 | A2 | 3/1995 |
| EP | 0800311 | A1 | 10/1997 |
| EP | 1093295 | A2 | 10/2000 |
| EP | 1231773 | A1 | 2/2001 |
| EP | 1939850 | A1 | 7/2008 |
| JP | H08-87250 | A | 4/1996 |
| JP | H11-65528 | A | 3/1999 |
| JP | 2002031846 | A | 1/2002 |
| JP | 2003177727 | A | 6/2003 |
| JP | 20050346032 | A | 12/2005 |
| JP | 2006276677 | A | 10/2006 |
| JP | 2006284981 | A | 10/2006 |
| JP | 200721085 | A1 | 2/2007 |
| JP | 2007140483 | A | 6/2007 |
| JP | 2007148331 | A | 6/2007 |
| KR | 20050120264 | A | 12/2005 |
| TW | 200721085 | A | 6/2007 |
| WO | 0227656 | A2 | 4/2002 |
| WO | 2005093703 | A1 | 10/2005 |
| WO | 2005119639 | A1 | 12/2005 |
| WO | 2006092679 | A2 | 9/2006 |
| WO | 2007046319 | A1 | 4/2007 |
| WO | 2007055703 | A1 | 5/2007 |

OTHER PUBLICATIONS

H. Seetzen et al., "Self-Calibrating wide color gamut high dynamic range display" Human Vision and Electronic Imaging XII, vol. 6492, No. 64920z, Feb. 12, 2007, pp. 1-9, XP040236320.

Anonymous: "Pulse-Amplitude-Modulation drive control of LEDs", IP.COM Journal, IP.COM Inc., West Henrietta, NY, Jul. 2, 2002, XP013003659, ISSN: 1533-0001.

Japanese Office Action for Application No. 2010-515080 dated Oct. 30, 2012; 3 pages.

Japanese Office Action for Application No. 2010-515082 dated Dec. 4, 2012; 4 pages.

Liang Cheng et al.; A Backlight optimization scheme for video playback on mobile devices, Consumer Communication and Networking Conference, 2006. CCNC 2006. 3rd IEEE, Issue Date: Jan. 8-10, 2006, vol. 2, on pp. 833-837, Print ISBN: 1-4244-0085-6, Date of Current Version: Feb. 13, 2006.

* cited by examiner

GAMMA-CORRECTION TECHNIQUE FOR VIDEO PLAYBACK

CROSS REFERENCE TO RELATED APPLICATIONS

This application claims priority under 35 U.S.C. 119(e) to U.S. Provisional Application Ser. No. 61/016,092 entitled "Management Techniques for Video Playback," by Ulrich T. Barnhoefer, Barry J. Corlett, Victor E. Alessi, Wei H. Yao and Wei Chen, filed on Dec. 21, 2007, to U.S. Provisional Application Ser. No. 61/016,100, entitled "Dynamic Backlight Adaptation," by Ulrich T. Barnhoefer, Barry J. Corlett, Victor E. Alessi, Wei H. Yao and Wei Chen, filed on Dec. 21, 2007, and to U.S. Provisional Application Ser. No. 60/946,270, entitled "Dynamic Backlight Adaptation," by Ulrich T. Barnhoefer, Barry J. Corlett, Victor E. Alessi, Wei H. Yao and Wei Chen, filed on Jun. 26, 2007, the contents of which are herein incorporated by reference.

This application is related to: (1) pending U.S. patent application Ser. No. 12/145,368, entitled "Dynamic Backlight Adaptation for Video Images With Black Bars," by Ulrich T. Barnhoefer, Wei H. Yao, Wei Chen and Barry J. Corlett, (2) pending U.S. patent application Ser. No. 12/145,388, entitled "Dynamic Backlight Adaptation With Reduced Flicker," by Ulrich T. Barnhoefer, Wei H. Yao, Wei Chen, Barry J. Corlett and Victor E. Alessi, (3) pending U.S. patent application Ser. No. 12/145,396, entitled "Synchronizing Dynamic Backlight Adaptation," by Ulrich T. Barnhoefer, Wei H. Yao, Wei Chen and Barry J. Corlett, (4) pending U.S. patent application Ser. No. 12/145,125, entitled "Dynamic Backlight Adaptation Using Selective Filtering," by Ulrich T. Barnhoefer, Wei H. Yao, Wei Chen, and Barry J. Corlett, (5) pending U.S. patent application Ser. No. 12/145,331, entitled "Dynamic Backlight Adaptation for Black Bars With Subtitles," by Ulrich T. Barnhoefer, Wei H. Yao, Wei Chen, Barry J. Corlett and Jean-Didier Allegrucci, (6) pending U.S. patent application Ser. No. 12/145,207, entitled "Light-Leakage-Correction Technique for Video Playback," by Ulrich Barnhoefer, Wei H. Yao, Wei Chen and Andrew Aitken, (7) pending U.S. patent application Ser. No. 12/145,308, entitled "Color-Adjustment Technique for Video Playback," by Ulrich Barnhoefer, Wei H. Yao, Wei Chen and Barry Corlett, (8) pending U.S. patent application Ser. No. 12/145,250, entitled "Technique for Adjusting White-Color-Filter Pixels," by Ulrich Barnhoefer, Wei H. Yao and Wei Chen, (9) pending U.S. patent application Ser. No. 12/145,266, entitled "Technique for Adjusting a Backlight During a Brightness Discontinuity," by Ulrich Barnhoefer, Wei H. Yao and Wei Chen, (10) pending U.S. patent application Ser. No. 12/145,292, entitled "Error Metric Associated With Backlight Adaptation," by Ulrich Barnhoefer, Wei H. Yao and Wei Chen, and (11) pending U.S. patent application Ser. No. 12/145,348, entitled "Management Techniques for Video Playback," by Ulrich T. Barnhoefer, Wei H. Yao and Wei Chen, the contents of all of which are herein incorporated by reference.

BACKGROUND

1. Field of the Invention

The present invention relates to techniques for dynamically adapting light sources for displays. More specifically, the present invention relates to circuits and methods for adjusting video signals and determining an intensity of a backlight on an image-by-image basis.

2. Related Art

Compact electronic displays, such as liquid crystal displays (LCDs), are increasingly popular components in a wide variety of electronic devices. For example, due to their low cost and good performance, these components are now used extensively in portable electronic devices, such as laptop computers.

Many of these LCDs are illuminated using fluorescent light sources or light emitting diodes (LEDs). For example, LCDs are often backlit by Cold Cathode Fluorescent Lamps (CCFLs) which are located above, behind, and/or beside the display. As shown in FIG. 1, which illustrates an existing display system in an electronic device, an attenuation mechanism 114 (such as a spatial light modulator) which is located between a light source 110 (such as a CCFL) and a display 116 is used to reduce an intensity of light 112 produced by the light source 110 which is incident on the display 116. However, battery life is an important design criterion in many electronic devices and, because the attenuation operation discards output light 112, this attenuation operation is energy inefficient, and hence can reduce battery life. Note that in LCD displays the attenuation mechanism 114 is included within the display 116.

In some electronic devices, this problem is addressed by trading off the brightness of video signals to be displayed on the display 116 with an intensity setting of the light source 110. In particular, many video images are underexposed, e.g., the peak brightness value of the video signals in these video images is less than the maximum brightness value allowed when the video signals are encoded. This underexposure can occur when a camera is panned during generation or encoding of the video images. While the peak brightness of the initial video image is set correctly (e.g., the initial video image is not underexposed), camera angle changes may cause the peak brightness value in subsequent video images to be reduced. Consequently, some electronic devices scale the peak brightness values in video images (such that the video images are no longer underexposed) and reduce the intensity setting of the light source 110, thereby reducing energy consumption and extending battery life.

However, it is often difficult to reliably determine the brightness of video images, and thus it is difficult to determine the scaling using existing techniques. For example, many video images are encoded with black bars or non-picture portions of the video images. These non-picture portions complicate the analysis of the brightness of the video images, and therefore can create problems when determining the trade-off between the brightness of the video signals and the intensity setting of the light source 110. Moreover, these non-picture portions can also produce visual artifacts, which can degrade the overall user experience when using the electronic device.

Additionally, because of gamma corrections associated with video cameras or imaging devices, many video images are encoded with a nonlinear relationship between brightness values and the brightness of the video images when displayed. Moreover, the spectrum of some light sources may vary as the intensity setting is changed. These effects can also complicate the analysis of the brightness of the video images and/or the determination of the appropriate trade-off between the brightness of the video image and the intensity setting of the light source 110.

Hence what is needed is a method and an apparatus that facilitates determining the intensity setting of a light source and which reduces perceived visual artifacts without the above-described problems.

SUMMARY

Embodiments of a technique for dynamically adapting the illumination intensity provided by a light source (such as an LED or a fluorescent lamp) that illuminates a display and for adjusting video images to be displayed on the display are described along with a system that implements the technique.

In some embodiments of the technique, the system transforms a video image from an initial brightness domain to a linear brightness domain, which includes a range of brightness values corresponding to substantially equidistant adjacent radiant-power values in a displayed video image. For example, the transformation may compensate for gamma correction in the video image that is associated with a video camera or, more generally, with an imaging device.

In this linear brightness domain, the system may determine an intensity setting (such as the average intensity setting) of the light source based on at least a portion of the transformed video image, such as a picture or image portion of the transformed video image. Moreover, the system may modify the transformed video image so that a product of the intensity setting and a transmittance associated with the modified video image approximately equals (which can include equality with) a product of a previous intensity setting and a transmittance associated with the video image. This modification may include changing brightness values in the transformed video image, for example, based on a histogram of brightness values in the transformed video image.

In other embodiments of the technique, the system adjusts brightness of pixels in the video image that are associated with black or dark regions in the same way as the remaining pixels in the video image. In particular, dark regions at an arbitrary location in the video image may be scaled to reduce or eliminate noise associated with pulsing or the backlight during transformations or conversions of the video image. For example, an offset associated with light leakage at low brightness values in a given display may be included in a transformation of the video image from the initial brightness domain to the linear brightness domain, and in a transformation of the modified video image from the linear brightness domain to the other brightness domain.

In other embodiments of the technique, the system applies a correction to maintain the color of a video image when the intensity setting of the light source is changed. After determining the intensity setting of the light source based on at least the portion of the video image, the system may modify brightness values of pixels in at least the portion of the video image to maintain the product of the intensity setting and the transmittance associated with the modified video image. Then, the system may adjust color content in the video image based on the intensity setting to maintain the color associated with the video image even as the spectrum associated with the light sources varies with the intensity setting.

Alternatively, prior to adjusting the color content, the system may jointly modify brightness values of pixels in at least the portion of the image and the intensity setting of the light source to maintain light output from a display while reducing power consumption by the light source.

In another embodiment of the technique, the system performs adjustments based on a saturated portion of the video image that is to be displayed on the display. This display may include pixels associated with a white color filter and pixels associated with one or more additional color filters. After optionally determining a color saturation of at least the portion of the video image, the system may selectively adjust pixels in the video image associated with the white color filter based on the color saturation. Then, the system may change an intensity setting of the light source based on the selectively adjusted pixels. Note that the selective disabling of pixels may be performed in a feed-forward architecture. For example, the presence of pixels having a saturated color in an upcoming video image in a sequence of video images (such as those associated with a webpage) may be predicted using motion estimation and some of these pixels may be adjusted, thereby reducing or eliminating visual artifacts.

In another embodiment of the technique, the system applies most or all of the changes to the intensity setting and scales the brightness values when there is a discontinuity in a brightness metric, such as a histogram of brightness values, between two adjacent video images in a sequence of video images.

In another embodiment of the technique, the system calculates an error metric for the video image based on the scaled brightness values and the video image. Thus, the error metric may correspond to a difference between a modified video image (after the scaling of the brightness values) and an initial video image. For example, a contribution of a given pixel in the video image to the error metric may correspond to a ratio of brightness value after the scaling to an initial brightness value before the scaling. Moreover, if the error metric exceeds a predetermined value, the system may reduce the scaling of the brightness values on a pixel-by-pixel basis and/or may reduce a change in the intensity setting, thereby reducing distortion when the video image is displayed.

In another embodiment of the technique, the system identifies another region in the video image in which the scaling of the brightness values results in a visual artifact associated with reduced contrast. For example, the other region may include a bright region surrounded by a darker region. Then, the system may reduce the scaling of the brightness values in the other region to, at least partially, restore the contrast, thereby reducing the visual artifact. Moreover, the system may spatially filter the brightness values in the video image to reduce a spatial discontinuity between the brightness values of pixels within the other region and the brightness values in a remainder of the video image.

BRIEF DESCRIPTION OF THE FIGURES

Note that like reference numerals refer to corresponding parts throughout the drawings.

DETAILED DESCRIPTION

Figure 1:
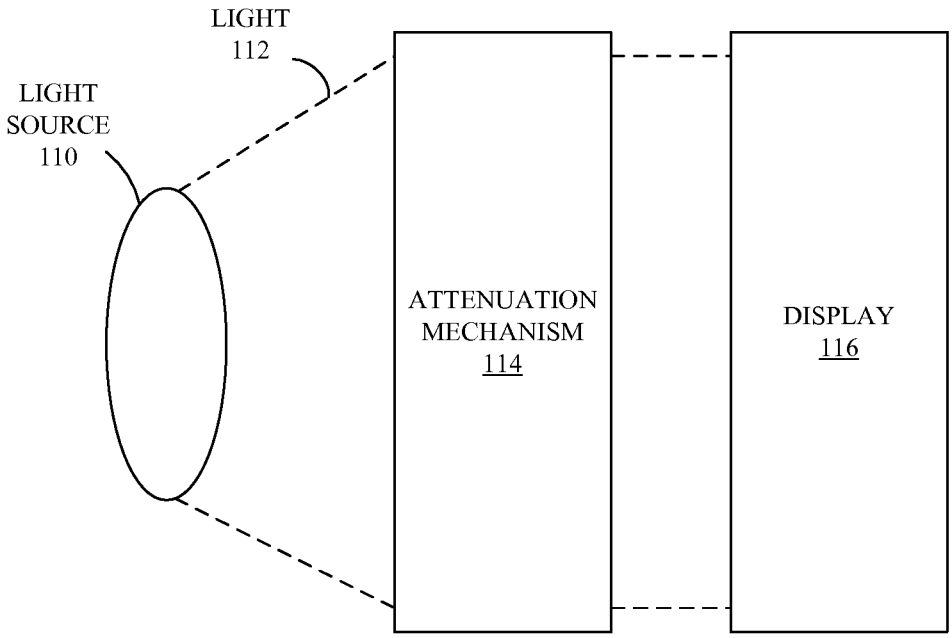
FIG. 1 (PRIOR ART)
FIG. 1 is a block diagram illustrating a display system.

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Embodiments of hardware, software, and/or processes for using the hardware and/or software are described. Note that hardware may include a circuit, a portable device, a system (such as a computer system), and software may include a computer-program product for use with the computer system. Moreover, in some embodiments the portable device and/or the system include one or more of the circuits.

These circuits, devices, systems, computer-program products, and/or processes may be used to determine an intensity of a light source, such as an LED (including an organic LED or OLED) and/or a fluorescent lamp (including an electro-fluorescent lamp). In particular, this light source may be used to backlight an LCD display in the portable device and/or the system, which displays video images (such as frames of video) in a sequence of video images. By determining a brightness metric (for example, a histogram of brightness values) of at least a portion of the one or more of the video images, the intensity of the light source may be determined. Moreover, in some embodiments video signals (such as the brightness values) associated with at least the portion of the one or more video images are scaled based on a mapping function which is determined from the brightness metric.

To facilitate this analysis and adjustment, in some embodiments the video images are first transformed from an initial brightness domain (which includes a gamma correction associated with a video camera or an imaging device) to a linear brightness domain, which includes a range of brightness values corresponding to substantially equidistant adjacent radiant-power values in a displayed video image. (Note that radiant power is also referred to as the optical power of the light that will be emitted from the display when the video image is displayed.) In the linear brightness domain, a video image may be modified (for example, by changing brightness values) so that a product of an intensity setting of the light source and a transmittance associated with the modified video image approximately equals (which can include equality with) a product of a previous intensity setting and a transmittance associated with the video image.

In some embodiments, the brightness metric is analyzed to identify a non-picture portion of the video image and/or a picture portion of the video image, e.g., a subset of the video image that includes spatially varying visual information. For example, video images are often encoded with one or more black lines and/or black bars (which may or more not be horizontal) that at least partially surround the picture portion of the video images. Note that this problem typically occurs with user-supplied content, such as that found on networks such as the Internet. By identifying the picture portion of the video image, the intensity of the light source may be correctly determined on an image-by-image basis. Thus, the intensity setting of the light source may be varied stepwise (as a function of time) from image to image in a sequence of video images.

Moreover, in some embodiments the non-picture portion of the video image can lead to visual artifacts. For example, in portable devices and systems that include the attenuation mechanism 114, the non-picture portions are often assigned a minimum brightness value, such as black. However, this brightness value may allow users to perceive noise associated with pulsing of the light source 110. Consequently, in some embodiments the brightness of the non-picture portion of the video image is scaled to a new brightness value that provides headroom to attenuate or reduce perception of this noise (for example, the change in brightness value may be at least 1 candela per square meter). Note that if the non-picture portion includes a subtitle, only the brightness of regions in the non-picture portion that exclude the subtitle may be modified.

More generally, arbitrary portions of the video image (as opposed to just those in the non-picture portion) may have brightness values below a threshold (such as black). Brightness values of these portions may be scaled to reduce user perception of noise associated with pulsing of the light source 110 and/or to improve contrast in the video image.

In some embodiments, there are large changes in brightness in adjacent video images in the sequence of video images, such as the brightness changes associated with the transition from one scene to the next in a movie. To prevent a filter from inadvertently smoothing out such changes, filtering of changes to the intensity of the light source for the video image may be selectively adjusted. Moreover, in some embodiments a buffer is used to synchronize the intensity setting of the light source with a current video image to be displayed.

Additionally, in some embodiments the discontinuity associated with such scene changes is used to mask changes to the intensity setting or the scaling of the brightness values. Consequently, most or all of these adjustments may be made when there is a discontinuity in a brightness metric, such as the histogram of brightness values, between two adjacent video images in a sequence of video images.

Note that the spectrum of some light sources, such as LEDs, can vary as the intensity setting is changed. Consequently, in some embodiments a correction may be applied to the color content of the video image to compensate for this effect based on the determined adjustment to the intensity setting. For example, the color white may be maintained to within approximately 100 K or 200 K of a corresponding black-body temperature associated with the color of the video image prior to changes in the intensity setting.

These techniques may also be used with displays that include pixels associated with a white color filter and pixels associated with one or more additional color filters. In particular, the color content in a saturated portion of the video image may be adjusted by selectively disabling pixels associated with the white color filter. Then, the intensity setting of the light source may be modified based on the selectively adjusted pixels. Moreover, if the spectrum of the light source depends on the intensity setting, the color content of the video image may be adjusted to maintain the color associated with the video image.

Note that an error metric, such as a ratio of brightness value after the scaling to an initial brightness value before the scaling, may be determined on a pixel-by-pixel basis. If the error metric exceeds a predetermined value, the scaling of the brightness values on a pixel-by-pixel basis and/or a change in the intensity setting may be reduced, thereby reducing distortion when the video image is displayed.

Additionally, one or more regions that are associated with visual artifacts may be identified. For example, these regions may include a bright portion surrounded by a darker portion. Scaling of the brightness values may reduce the contrast in the bright portion producing a visual artifact (e.g., an artifact that at least some users can perceive). To mitigate or eliminate these artifacts, scaling of the brightness values in at least the bright portion of a given region may be reduced. Moreover, the system may spatially filter the brightness values in the video image to reduce a spatial discontinuity between the brightness values of pixels within the other region and the brightness values in a remainder of the video image.

By determining the intensity setting of the light source on an image-by-image basis, these techniques facilitate a reduction in the power consumption of the light source. In an exemplary embodiment, the power savings associated with the light source can be between 15-50%. This reduction provides additional degrees of freedom in the design of portable devices and/or systems. For example, using these techniques portable devices may: have a smaller battery, offer longer playback time, and/or include a larger display.

Note that these techniques may be used in a wide variety of portable devices and/or systems. For example, the portable device and/or the system may include: a personal computer, a laptop computer, a cellular telephone, a personal digital assistant, an MP3 player, and/or another device that includes a backlit display.

Techniques to determine an intensity of the light source in accordance with embodiments of the invention are now described. In the embodiments that follow, a histogram of brightness values in a given video image is used as an illustration of a brightness metric from which the intensity of the light source is determined. However, in other embodiments one or more additional brightness metrics (such as the color saturation) are used, either separately or in conjunction, with the histogram.

Figure 2A:
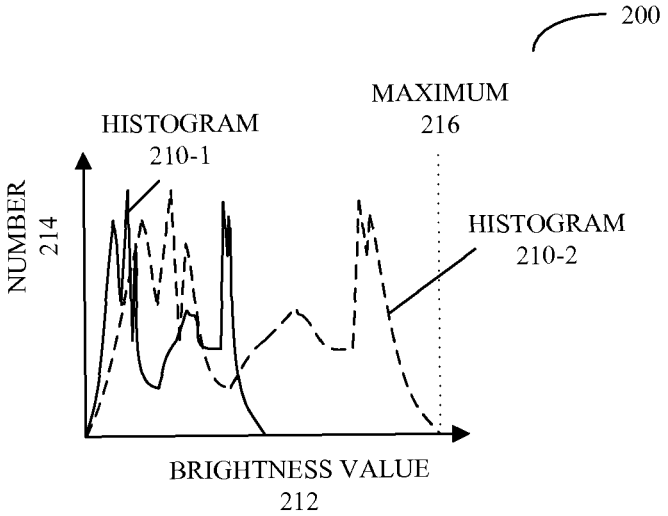
FIG. 2A is a graph illustrating histograms of brightness values in a video image in accordance with an embodiment of the present invention.

FIG. 2A presents a graph 200 illustrating an embodiment of histograms 210 of brightness values, plotted as a number 214 of counts as a function of brightness value 212, in a video image (such as a frame of video). Note that the peak brightness value in an initial histogram 210-1 is less than a maximum 216 brightness value that is allowed when encoding the video image. For example, the peak value may be associated with a grayscale level of 202 and the maximum 216 may be associated with a grayscale level of 255. If a gamma correction of a display that displays the video image is 2.2, the brightness associated with the peak value is around 60% of the maximum 216. Consequently, the video image is underexposed. This common occurrence often results during panning. In particular, while an initial video image in a sequence of video images, for example, associated with a scene in a movie, has a correct exposure, as the camera is panned the subsequent video images may be underexposed.

In display systems, such as those that include an LCD display (and more generally, those that include the attenuation mechanism 114 in FIG. 1), underexposed video images waste power because the light output by the light source 110 (FIG. 1) that illuminates the display 116 (FIG. 1) will be reduced by the attenuation mechanism 114 (FIG. 1).

However, this provides an opportunity to save power while maintaining the overall image quality. In particular, the brightness values in at least a portion of the video image may be scaled up to the maximum 216 (for example, by redefining the grayscale levels) or even beyond the maximum 216 (as described further below). This is illustrated by histogram 210-2. Note that the intensity setting of the light source is then reduced (for example, by changing the duty cycle or the current to an LED) such that the product of the peak value in the histogram 210-2 and the intensity setting is approximately the same as before the scaling. In an embodiment where the video image is initially 40% underexposed, this technique offers the ability to reduce power consumption associated with the light source by approximately 40%, i.e., significant power savings.

Figure 2B:
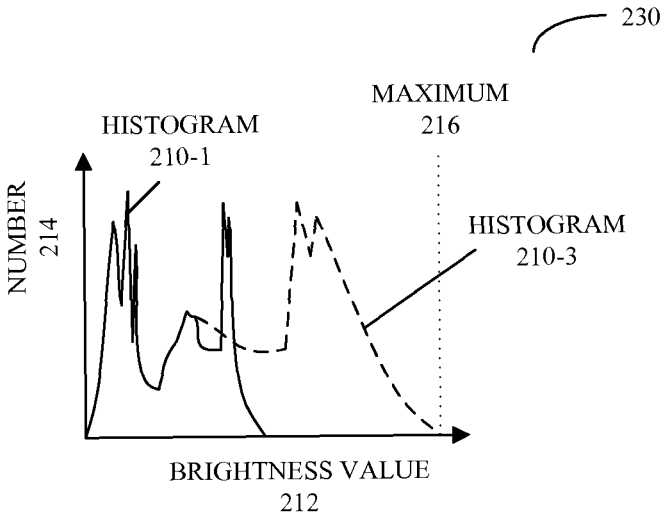
FIG. 2B is a graph illustrating histograms of brightness values in a video image in accordance with an embodiment of the present invention.

While the preceding example scaled the brightness of the entire video image, in some embodiments the scaling may be applied to a portion of the video image. For example, as shown in FIG. 2B, which presents a graph 230 illustrating an embodiment of histograms 210 of brightness values in the video image, brightness values in the video image associated with a portion of the histogram 210-1 may be scaled to produce histogram 210-3. Note that scaling of the brightness values associated with the portion of the histogram 210-1 may be facilitated by tracking a location (such as a line number or a pixel) associated with a given contribution to the histogram 210-1. In general, the portion of the video image (and, thus, the portion of the histogram) that is scaled may be based on the distribution of values in the histogram, such as: a weighted average, one or more moments of the distribution, and/or the peak value.

Moreover, in some embodiments this scaling may be non-linear and may be based on a mapping function (which is described further below with reference to FIG. 3). For example, brightness values in the video image associated with a portion of the histogram may be scaled to a value larger than the maximum 216, which facilitates scaling for video images that are saturated (e.g., video images that initially have a histogram of brightness values with peak values equal to the maximum 216). Then, a non-linear compression may be applied to ensure that the brightness values in the video image (and, thus, in the histogram) are less than the maximum 216.

Note that while FIGS. 2A and 2B illustrate scaling of the brightness values for the video image, these techniques may be applied to a sequence of video images. In some embodiments, the scaling and the intensity of the light source are determined on an image-by-image basis from a histogram of brightness values for a given video image in the sequence of video images. In an exemplary embodiment, the scaling is first determined based on the histogram for the video image and then the intensity setting is determined based on the scaling (for example, using a mapping function, such as that described below with reference to FIG. 3). In other embodiments, the intensity setting is first determined based on the histogram for the video image, and then the scaling is determined based on the intensity setting for this video image.

Figure 3:
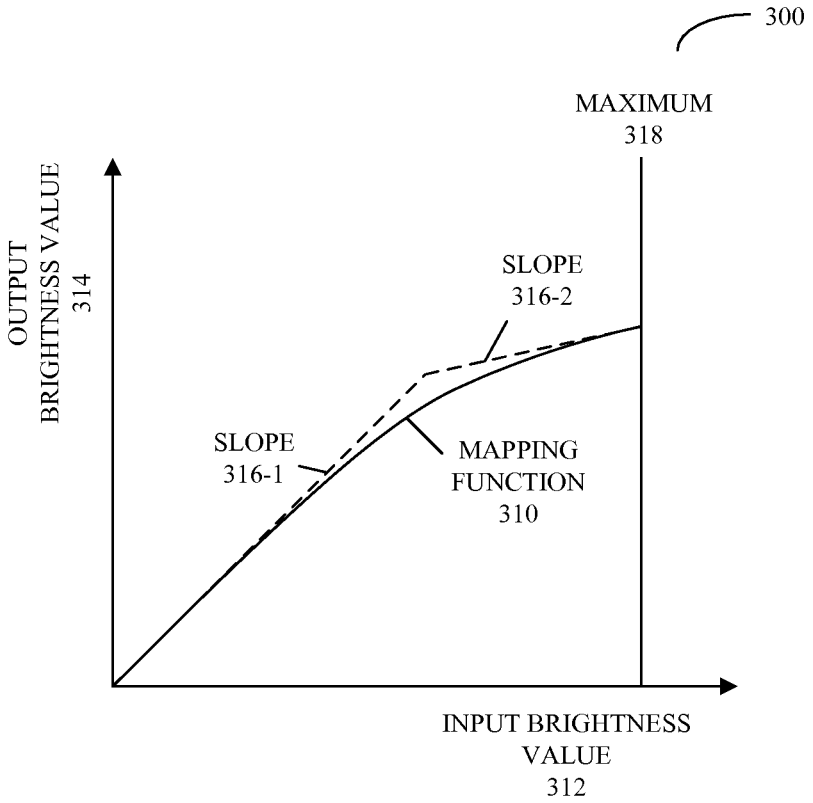
FIG. 3 is a graph illustrating a mapping function in accordance with an embodiment of the present invention.

FIG. 3 presents a graph 300 illustrating an embodiment of a mapping function 310, which performs a mapping from an input brightness value 312 (up to a maximum 318 brightness value) to an output brightness value 314. In general, the mapping function 310 includes a linear portion associated with slope 316-1 and a non-linear portion associated with slope 316-2. Note that in general the non-linear portion(s) may be at arbitrary position(s) in the mapping function 310. In an exemplary embodiment where the video image is under-exposed, the slope 316-1 is greater than one and the slope 316-2 is zero.

Note that for a given mapping function, which may be determined from the histogram of the brightness values for at least a portion of the video image, there may be an associated distortion metric. For example, the mapping function 310 may implement a non-linear scaling of brightness values in a portion of a video image and the distortion metric may be a percentage of the video image that is distorted by this mapping operation.

In some embodiments, the intensity setting of the light source for the video image is based, at least in part, on the associated distortion metric. For example, the mapping function 310 may be determined from the histogram of the brightness values for at least a portion of the video image such that the associated distortion metric (such as a percentage distortion in the video image) is less than a pre-determine value, such as 10%. Then, the intensity setting of the light source may be determined from the scaling of the histogram associated with the mapping function 310. Note that in some embodiments the scaling (and, thus, the intensity setting) is based, at least in part, on a dynamic range of the attenuation mechanism 114 (FIG. 1), such as a number of grayscale levels.

Moreover, note that in some embodiments the scaling is applied to grayscale values or to brightness values after including the effect of the gamma correction associated with the video camera or the imaging device that captured the video image. For example, the video image may be compensated for this gamma correction prior to the scaling. In this way, artifacts, which are associated with the non-linear relationship between the brightness values in the video image and the brightness of the displayed video image, and which can occur during the scaling, can be avoided.

Figure 4:
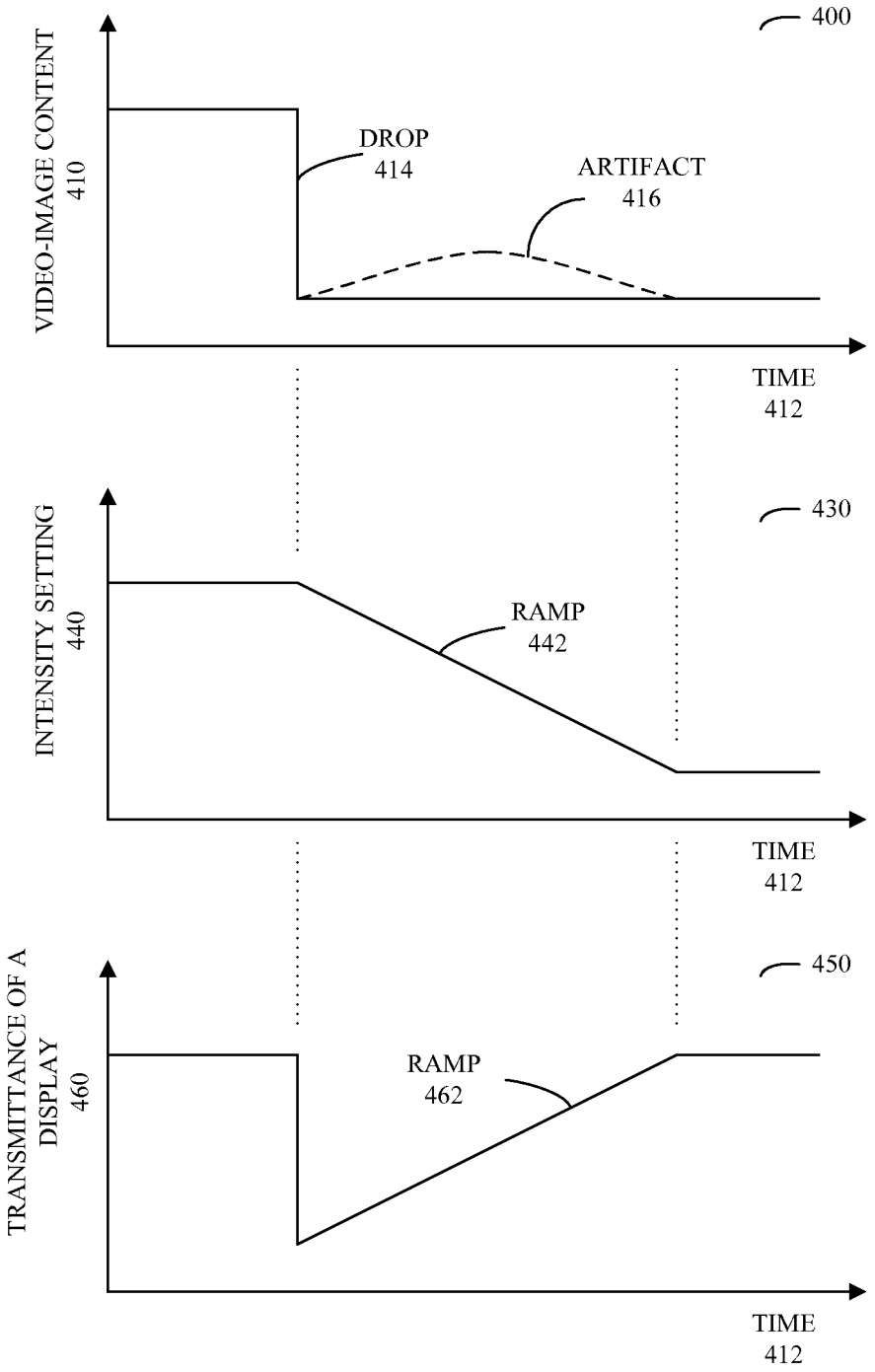
FIG. 4 is a series of graphs illustrating the impact of a non-linearity in brightness when adjusting an intensity setting of a light source and brightness values of a video image in accordance with an embodiment of the present invention.

FIG. 4 presents a series of graphs 400, 430 and 450 illustrating the impact of this non-linearity when adjusting an intensity setting of a light source and brightness values of a video image. Graph 400 shows video-image content 410 as a function of time 412, including a discontinuous drop 414 in the brightness value. This drop allows power to be saved by reducing the intensity setting of the light source. As shown in graph 430, which shows intensity setting 440 as a function of time 412, the intensity setting 440 can be decreased using a decreasing ramp 442 over a time interval, such as 10 frames. Moreover, as shown in graph 450, which shows transmittance of a display 460 as a function of time 412, by using an increasing ramp 462 (which corresponds to a 1/x function in a linear brightness domain) the desired brightness values associated with the video-image content 410 can be obtained.

However, if the computations of the scaling of the brightness values are performed in the initial brightness domain of the video image, which include the gamma correction of the video camera or the imaging device that captured the video image and, as such, have a non-linear relationship between the brightness values and the brightness of the displayed video image (i.e., the relationship between the brightness values and the brightness is non-linear), artifacts, such artifact 416, can occur. This artifact may lead to a 20% jump in the brightness value.

Figure 5:
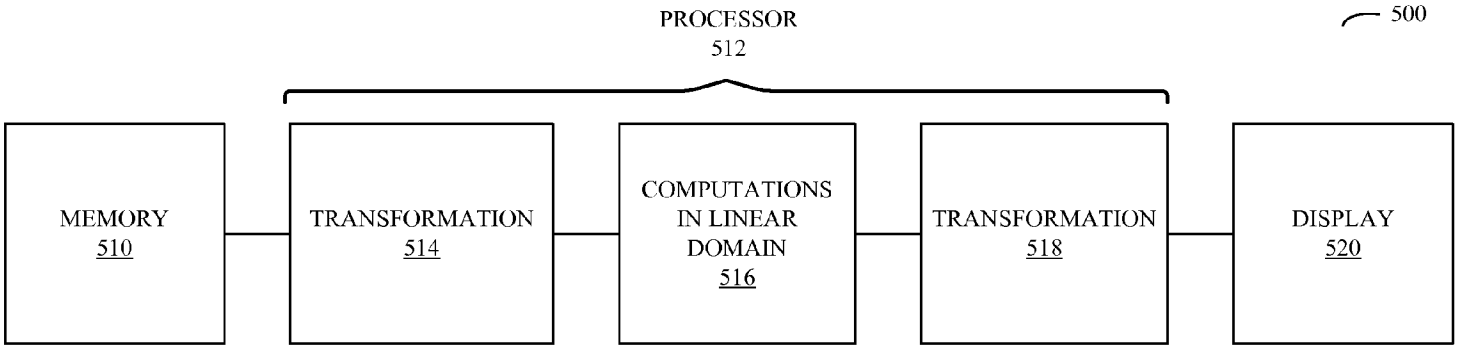
FIG. 5 is a block diagram illustrating an imaging pipeline in accordance with an embodiment of the present invention.

Consequently, in some embodiments the video image is transformed from an initial (non-linear) brightness domain to a linear brightness domain in which the range of brightness values corresponds to substantially equidistant adjacent radiant-power values in a displayed video image. This is shown in FIG. 5, which presents a block diagram illustrating an imaging pipeline 500.

In this pipeline, the video image is received from memory 510. During processing in processor 512, the video image is converted or transformed from the initial brightness domain to the linear brightness domain using transformation 514. For example, transformation may compensate for a gamma correction of a given video camera or a given imaging device by applying an exponent of 2.2 to the brightness values (as described below with reference to FIG. 6A). In general, this transformation may be based on a characteristic (such as the particular gamma correction) of the video camera or the imaging device that captured the video image. Consequently, a look-up table may include the appropriate transformation function for a given video camera or a given imaging device. In an exemplary embodiment, the look-up table may include 12-bit values.

After transforming the video image, the processor 512 may perform computations in the linear domain 516. For example, the processor 512 may determine the intensity setting of the light source and/or scale or modify the brightness values of the video image (or, more generally, the content, including the color content, of the video image). In some embodiments, a product of the intensity setting and a transmittance associated with the modified video image approximately equals (which can include equality with) a product of a previous intensity setting and a transmittance associated with the video image. Moreover, the modifications to the video image may be based on a metric (such as a histogram of brightness values) associated with at least a portion of the video image, and may be performed on a pixel-by-pixel basis.

After modifying the video image, the processor 512 may convert or transform the modified video image using transformation 518 to another brightness domain characterized by the range of brightness values corresponding to non-equidistant adjacent radiant-power values in a displayed video image. For example, this transformation may be approximately the same as the initial brightness domain. Consequently, the transformation to the other brightness domain may restore an initial gamma correction (which is associated with a video camera or an imaging device that captured the video image) in the modified video image, for example, by applying an exponent of 1/2.2 to the brightness values in the modified video image. Alternatively, the transformation to the other brightness domain may be based on characteristics of the display, such as a gamma correction associated with a given display (as described below with reference to FIG. 6B). Note that the appropriate transformation function for the given display may be stored in a look-up table. Then, the video image may be output to display 520.

In some embodiments, the transformation to the other brightness domain may include a correction for an artifact in the display, which the processor 512 may selectively apply on a frame-by-frame basis. In an exemplary embodiment, the display artifact includes light leakage near minimum brightness in the display.

Figure 6B:
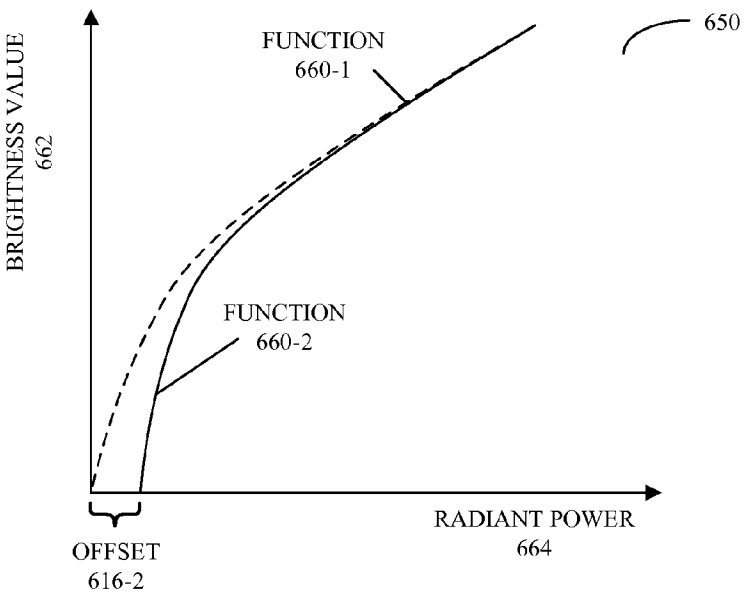
FIG. 6B is a graph illustrating transformations in accordance with an embodiment of the present invention.
Figure 6A:
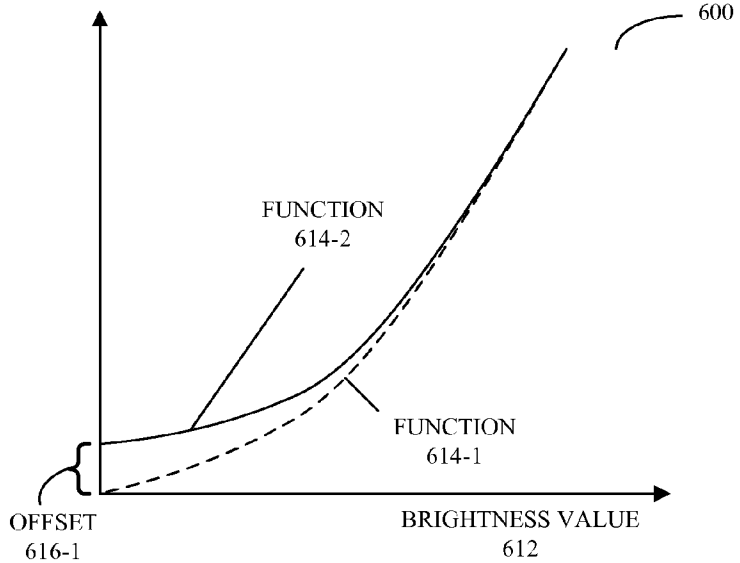
FIG. 6A is a graph illustrating transformations in accordance with an embodiment of the present invention.

FIG. 6A presents a graph 600 illustrating transformations 614 (such as transformation 514 in FIG. 5) plotted as radiant power 610 (or photon count) as a function of brightness value 612 in the video image (as captured by a given video camera or a given imaging device). Transformation 614-1, which includes compensation or decoding for the gamma or gamma correction associated with the given video camera or the given imaging device, may be used to convert from an initial brightness domain to the linear brightness domain.

In some embodiments, as illustrated in transformation 614-2, an offset 616-1 (characterized by a shallower slope at smaller brightness values 612) along the radiant-power axis is included (in general, transformation 614-2 has a different shape than transformation 614-1). Note that this offset effectively restricts the range of the values of the radiant power 610 and may be associated with a characteristic of a given display (such as display 520 in FIG. 5) that will display the video image. For example, the offset 616-1 may be associated with light leakage in the display. Consequently, transformation 614-2 may intentionally distort the video image (as captured by the given video camera or the given imaging device) such that the range of values of the radiant power 610 corresponds to the range of radiant power associated with the display.

Moreover, in conjunction with transformation 660-2 described below with reference to FIG. 6B, transformation 614-2 may allow a generalized scaling of brightness values 612 to be applied to dark regions in the video image (as described further with reference to FIGS. 8A and 8B). Note that this generalized scaling of the dark regions may reduce or eliminate user perception of noise associated with modulation of the backlight.

FIG. 6B, which presents a graph 650 illustrating transformations 660 (such as transformation 518 in FIG. 5) plotted as brightness values 662 in the video image (as displayed on a given display) as a function of radiant power 664 (or photon count). Transformation 660-1, which includes compensation or encoding for the gamma or gamma correction associated with the given display (e.g., transformation 660-1 may approximately invert the display gamma), may be used to convert from the linear brightness domain to the other brightness domain.

In some embodiments, as illustrated in transformation 660-2, an offset 616-2 (characterized by a steeper slope at smaller values of the radiant power 664) along the radiant-power axis is included (in general, transformation 660-2 has a different shape than transformation 660-1). Note that this offset effectively restricts the range of the values of the radiant power 664. Consequently, transformation 660-2 may be a better approximation to or an exact inversion of the display gamma. Note that the offset 616-2 may be associated with a characteristic of the given display (such as display 520 in FIG. 5) that will display the video image. For example, the offset 616-2 may be associated with light leakage in the display. Moreover, transformation 660-2, in conjunction with transformation 614-2 (FIG. 6A), may also allow a generalized scaling of brightness values 622 to be applied to dark regions in the video image (as described further with reference to FIGS. 8A and 8B). As noted above, this generalized scaling of the dark regions may reduce or eliminate user perception of noise associated with modulation of the backlight.

Additionally, transformation 660-2 may offer: stable radiant power in the displayed video image even as the intensity setting and the brightness values are scaled; and the contrast in dark regions in the video image may be increased when the intensity setting is reduced (at the expense of some clipping of content in the dark regions). Note that when transformation 660-2 is used in conjunction with transformation 614-2, there may not be clipping of the content in the dark regions. However, in these embodiments the contrast in the dark regions will not be enhanced.

Note that in some embodiments the contrast in the dark regions may still be enhanced by adjusting offset 616-1 (FIG. 6A) when the intensity setting is reduced. In these embodiments, there is no clipping of the content in the dark regions. However, the generalized technique for scaling brightness values 622 in the dark regions in the video image may not work when offset 616-1 (FIG. 6A) is adjusted. Instead, portions of the video image associated with dark regions (such as black bars and black lines) may be identified and appropriately scaled to reduce or eliminate user perception of noise associated with modulation of the backlight (as described further below with reference to FIGS. 8A and 8B).

One or more circuits or sub-circuits in a circuit, which may be used to modify the video image and/or to determine the intensity setting of the given video image in a sequence of video images, in accordance with embodiments of the invention are now described. These circuits or sub-circuits may be included on one or more integrated circuits. Moreover, the one or more integrated circuits may be included in devices (such as a portable device that includes a display system) and/or a system (such as a computer system).

Figure 7A:
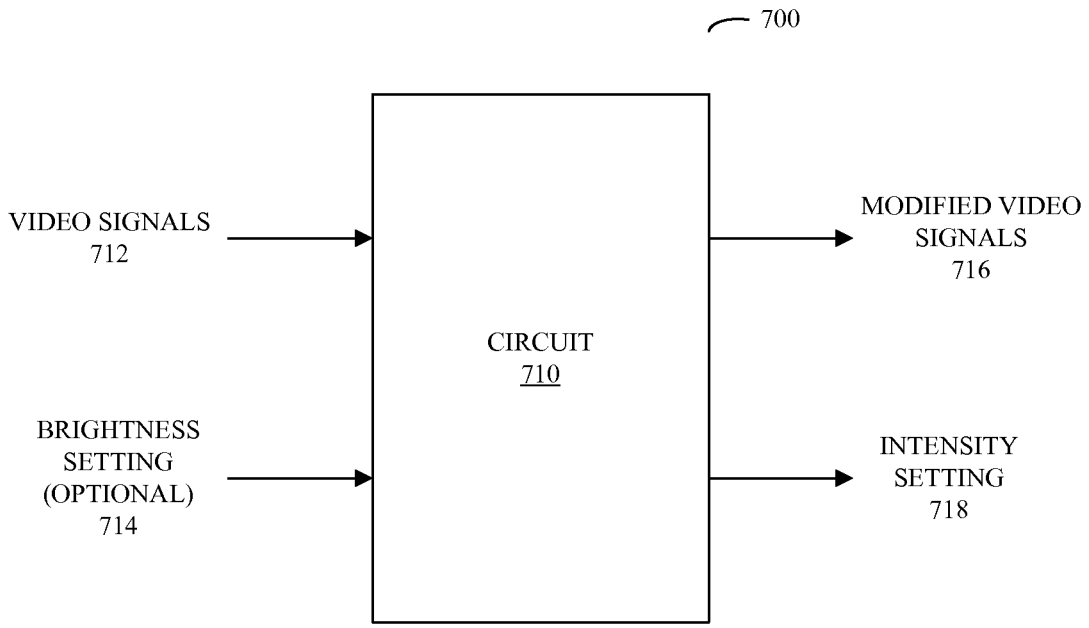
FIG. 7A is a block diagram illustrating a circuit in accordance with an embodiment of the present invention.

FIG. 7A presents a block diagram illustrating an embodiment 700 of a circuit 710. This circuit receives video signals 712 (such as RGB) associated with a given video image in a sequence of video images and outputs modified video signals 716 and an intensity setting 718 of the light source for the given video image. Note that the modified video signals 716 may include scaled brightness values for at least a portion of the given video image. Moreover, in some embodiments the circuit 710 receives information associated with video images in the sequence of video images in a different format, such as YUV.

In some embodiments, the circuit 710 receives an optional brightness setting 714. For example, the brightness setting 714 may be a user-supplied brightness setting for the light source (such as 50%). In these embodiments, the intensity setting 718 may be a product of the brightness setting 714 and an intensity setting (such as a scale value) that is determined based on the histogram of brightness values of the video image and/or the scaling of histogram of brightness values of the video image. Moreover, if the intensity setting 718 is reduced by a factor corresponding to the optional brightness setting 714, the scaling of the histogram of brightness values (e.g., the mapping function 310 in FIG. 3) may be adjusted by the inverse of the factor such that the product of the peak value in the histogram and the intensity setting 718 is approximately constant. This compensation based on the optional brightness setting 714 may prevent visual artifacts from being introduced when the video image is displayed.

Moreover, in some embodiments the determination of the intensity setting is based on one or more additional inputs, including: an acceptable distortion metric, a power-savings target, the gamma correction associated with the display (and more generally, a saturation boost factor associated with the display), a contrast improvement factor, a portion of the video image (and, thus, a portion of the histogram of brightness values) to be scaled, and/or a filtering time constant.

Figure 7B:
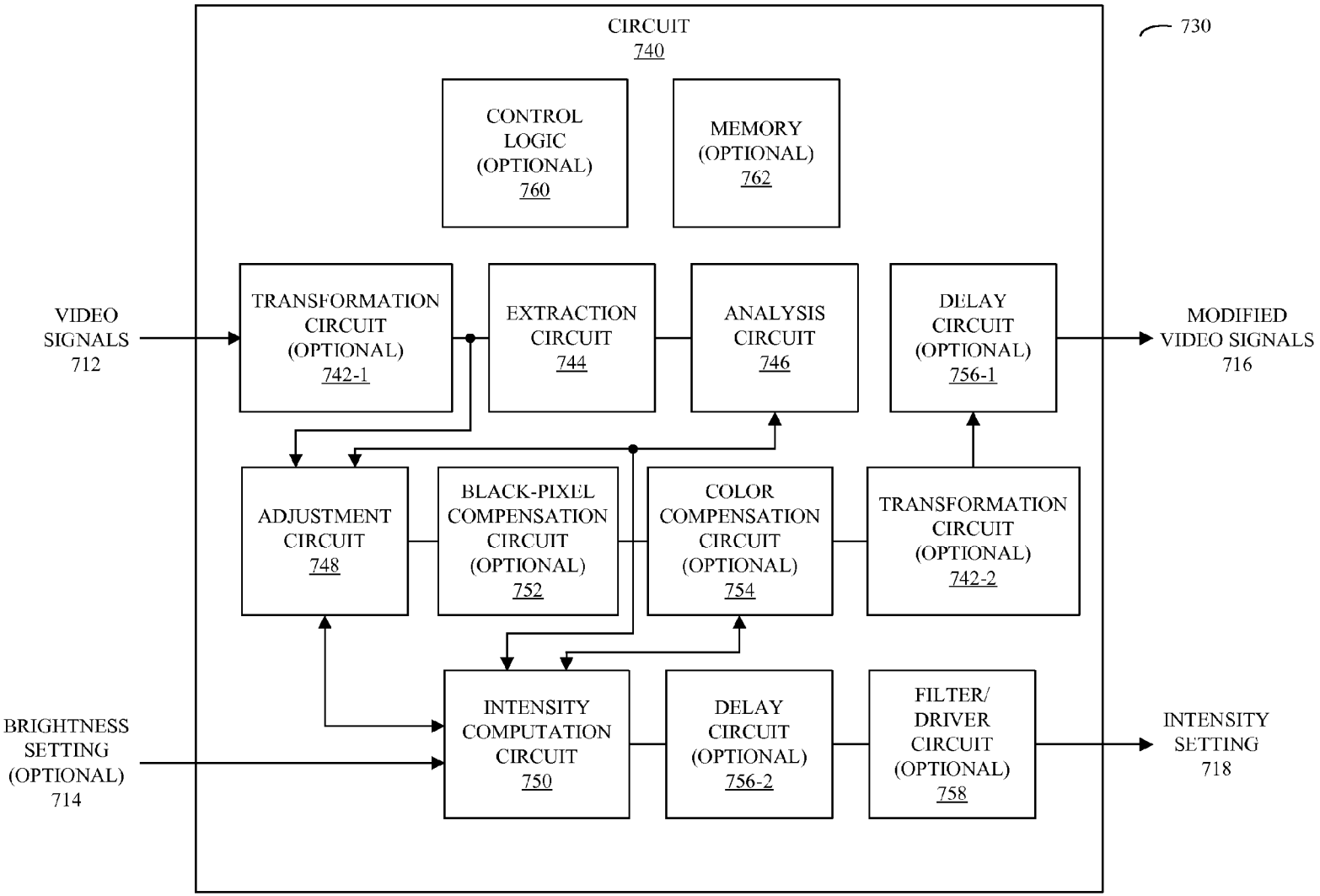
FIG. 7B is a block diagram illustrating a circuit in accordance with an embodiment of the present invention.

FIG. 7B presents a block diagram illustrating an embodiment 730 of a circuit 740. This circuit includes an interface (not shown) that receives the video signals 712 associated with the video image, which is electrically coupled to: optional transformation circuit 742-1, extraction circuit 744, and adjustment circuit 748. Note that the optional transformation circuit 742-1 may convert the video signals 712 to the linear brightness domain, for example, using one of the transformations 614 (FIG. 6A). Moreover, note that in some embodiments the circuit 740 optionally receives the brightness setting 714.

Extraction circuit 744 calculates one or more metrics, such as saturation values and/or a histogram of brightness values, based on at least some of the video signals, e.g., based on at least a portion of the video image. In an exemplary embodiment, the histogram is determined for the entire video image.

These one or more metrics are then analyzed by analysis circuit 746 to identify one or more subsets of the video image. For example, picture and/or non-picture portions of the given image may be identified based on the associated portions of the histogram of brightness values (as described further below with reference to FIGS. 8A and 8B). In general, the picture portion(s) of the video image include spatially varying visual information, and the non-picture portion(s) include the remainder of the video image. In some embodiments, the analysis circuit 746 is used to determine a size of the picture portion of the video image. Additionally, in some embodiments the analysis circuit 746 used to identify one or more subtitles in the non-picture portion(s) of the video image (as described further below with reference to FIG. 8A) and/or portions of the video image that include a saturated color.

More generally, the analysis circuit 746 may be used to identify an arbitrary portion of the video image (e.g., pixels in either the picture portion and/or the non-picture portions) that has brightness values less than a threshold (as described further below with reference to FIGS. 8A and 8B). However, as noted previously, in some embodiments the non-picture or arbitrary portion of the video image may not need to be identified. Instead, the non-picture or arbitrary portion of the video image may be scaled using transformations in optional transformation circuits 742, such as transformations 614-2 (FIG. 6A) and 660-2 (FIG. 6B), as described further below with reference to FIGS. 8A and 8B. Additionally, in embodiments where the video signals are to be displayed on a display that includes pixels associated with a white color filter as well as pixels associated with additional color filters, the analysis circuit 746 may identify pixels associated with the white color filter based on a saturation value.

Using the portion(s) of the one or more metrics (such as the histogram) associated with the one or more subsets of the video image, adjustment circuit 748 may determine the scaling of the portion(s) of the video image, and thus, the scaling of the one or more metrics. For example, the adjustment circuit 748 may determine the mapping function 310 (FIG. 3) for the video image, and may scale brightness values in the video signals based on this mapping function. Then, scaling information may be provided to intensity computation circuit 750, which determines the intensity setting 718 of the light source on an image-by-image basis using this information. As noted previously, in some embodiments this determination is also based on optional brightness setting 714. Moreover, an output interface (not shown) may output the modified video signals 716 and/or the intensity setting 718. Note that in some embodiments the video image includes one or more subtitles, and the brightness values of pixels in the non-picture portion(s) associated with the subtitles may be unchanged during the scaling of the non-picture portion(s) (as described further below with reference to FIG. 8A). However, brightness values of pixels associated with the one or more subtitles may be scaled in the same manner as the brightness values of pixels in the picture portion of the video image.

In an exemplary embodiment, the non-picture portion(s) of the video image include one or more black lines and/or one or more black bars (henceforth referred to as black bars for simplicity). Black bars are often displayed with a minimum brightness value (such as 1.9 nits), which is associated with light leakage in a display system. However, this minimum value may not provide sufficient headroom to allow adaptation of the displayed video image to mask pulsing of a backlight.

Consequently, in some embodiments an optional black-pixel adjustment or compensation circuit 752 is used to adjust a brightness of the non-picture portion(s) of the video image. The new brightness value of the non-picture portion(s) of the video image provides headroom to attenuate noise associated with the display of the video image, such as the noise associated with pulsing of the backlight. In particular, the display may now have inversion levels with which to suppress light leakage associated with the pulsing. However, as noted previously, in some embodiment rather than correcting non-picture portions of the video image (such as one or more black bars), circuit 740 may implement this scaling to arbitrary portions of the video image, such as dark regions of the video image, using optional transformation circuits 742.

In an exemplary embodiment, the grayscale value of the one or more black bars or dark regions located at an arbitrary location in the video image can be increased from 0 to 6-10 (relative to a maximum value of 255) or a brightness increase of at least 1 candela per square meter. In conjunction with the gamma correction and light leakage of the display in a typical display system, this adjustment may increases the brightness of the one or more black bars or dark regions by around a factor of 2, representing a trade-off between the brightness of the black bars or dark regions and perception of the pulsing of the backlight.

In some embodiments, the circuit 740 includes an optional color compensation circuit 754. This optional color compensation circuit may adjust color content of the video signals to compensate or correct for changes in the spectrum of a light source (such as an LED) that illuminates a display that will display the video image. In particular, if the spectrum depends on the intensity setting determined by the intensity computation circuit 750, the color content may be adjusted to maintain the color white. More generally, this technique may be used to maintain an arbitrary color. Note that such color compensation may also be applied in embodiments where the display includes the white color filter and the additional color filters, and where pixels associated with the white color filter are selectively adjusted (for example, over a range of white-color values) based on the color saturation of at least some of these pixels.

Prior to outputting the modified video signals 716, optional transformation circuit 742-2 may convert the video signals back to the initial (non-linear) brightness domain, which is characterized by a range of brightness values corresponding to non-equidistant adjacent radiant-power values in a displayed video image. Alternatively, optional transformation circuit 742-2 may convert the modified video signals 716 to another brightness domain, which is characterized by a range of brightness values corresponding to non-equidistant adjacent radiant-power values in a displayed video image. However, this transformation may be based on characteristic of the display, such as a leakage level of the display and/or a gamma correction associated with the display, for example, using one of the transformations 660 (FIG. 6B).

Moreover, in some embodiments the circuit 740 includes an optional filter/driver circuit 758. This circuit may be used to filter, smooth, and/or average changes in the intensity setting 718 between adjacent video images in the sequence of video images. This filtering may provide systematic under-relaxation, thereby limiting the change in the intensity setting 718 from image to image (e.g., spreading changes out over several frames). Additionally, the filtering may be used to apply advanced temporal filtering to reduce or eliminate flicker artifacts and/or to facilitate larger power reduction by masking or eliminating such artifacts. In an exemplary embodiment, the filtering implemented by the optional filter/driver circuit 758 includes a low-pass filter. Moreover, in an exemplary embodiment the filtering or averaging is over 2, 4, or 10 frames of video. Note that a time constant associated with the filtering may be different based on a direction of a change in the intensity setting and/or a magnitude of a change in the intensity setting.

In some embodiments, the optional filter/driver circuit 758 maps from a digital control value to an output current that drives an LED light source. This digital control value may have 7 or 8 bits.

Note that the filtering may be asymmetric depending on the sign of the change. In particular, if the intensity setting 718 decreases for the video image, this may be implemented using the attenuation mechanism 114 (FIG. 1) without producing visual artifacts, at the cost of slightly higher power consumption for a few video images. However, if the intensity setting 718 increases for the video image, visual artifacts may occur if the change in the intensity setting 718 is not filtered.

These artifacts may occur when the scaling of the video signals is determined. Recall that the intensity setting 718 may be determined based on this scaling. However, when filtering is applied, the scaling may need to be modified based on the intensity setting 718 output from the filter/driver circuit 758 because there may be mismatches between the calculation of the scaling and the related determination of the intensity setting 718. Note that these mismatches may be associated with component mismatches, a lack of predictability, and/or non-linearities. Consequently, the filtering may reduce perception of visual artifacts associated with errors in the scaling for the video image associated with these mismatches.

Note that in some embodiments the filtering is selectively adjusted if there is a large change in the intensity setting 718, such as that associated with the transition from one scene to another in a movie. For example, the filtering may be selectively adjusted if the peak value in a histogram of brightness values increases by 50% between adjacent video images. This is described further below with reference to FIG. 10.

In some embodiments, the circuit 740 uses a feed-forward technique to synchronize the intensity setting 718 with the modified video signals 716 associated with a current video image that is to be displayed. For example, the circuit 740 may include one or more optional delay circuits 756 (such as memory buffers) that delay the modified video signals 716 and/or the intensity setting 718, thereby synchronizing these signals. In an exemplary embodiment, the delay is at least as long as a time interval associated with the video image.

Note that in some embodiments the circuits 710 (FIG. 7A) and/or 740 include fewer or additional components. For example, functions in the circuit 740 may be controlled using optional control logic 760, which may use information stored in optional memory 762. In some embodiments, analysis circuit 746 jointly determines the scaling of the video signals and the intensity setting of the light source, which are then provided to the adjustment circuit 748 and the intensity computation circuit 750, respectively, for implementation.

Moreover, two or more components can be combined into a single component and/or a position of one or more components can be changed. In some embodiments, some or all of the functions in the circuits 710 (FIG. 7A) and/or 740 are implemented in software.

Identification of the picture and non-picture portions of the video image in accordance with embodiments of the invention are now further described. FIG. 8A presents a block diagram illustrating an embodiment of a picture portion 810 and non-picture portions 812 of a video image 800. As noted previously, the non-picture portions 812 may include one or more black lines and/or one or more black bars. However, note that the non-picture portions 812 may or may not be horizontal. For example, non-picture portions 812 may be vertical.

Non-picture portions 812 of the video image may be identified using an associated histogram of brightness values. This is shown in FIG. 8B, which presents a graph 830 illustrating an embodiment of a histogram of brightness values in a video image, plotted as a number 842 of counts as a function of brightness value 840. This histogram may have a maximum 844 brightness value that is less than a predetermined value, and a range of values 846 that is less than another predetermined value. For example, the maximum 844 may be a gray-scale value of 20 or, with a video-camera or imaging-device gamma correction of 2.2, a brightness value of 0.37% of the maximum brightness value.

In some embodiments, one or more non-picture portions 812 (FIG. 8A) of a video image include one or more subtitles (or, more generally, overlaid text or characters). For example, a subtitle may be dynamically generated and associated with the video image. Moreover, in some embodiments a component (such as the circuit 710 in FIG. 7A) may blend the subtitle with an initial video image to produce the video image. Additionally, in some embodiments the subtitle is included in the video image that is received by the component (e.g. the subtitle is already embedded in the video image).

Figure 8A:
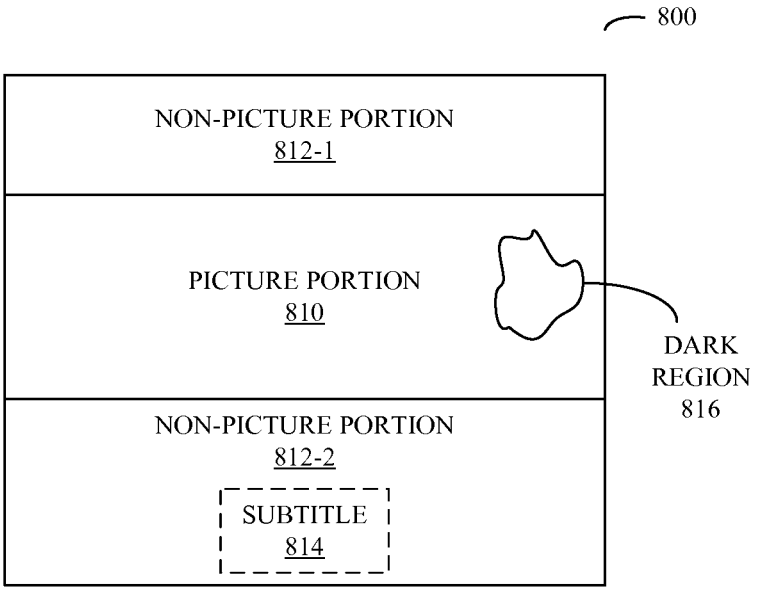
FIG. 8A is a block diagram illustrating picture and non-picture portions of a video image in accordance with an embodiment of the present invention.

Continuing the discussion of FIG. 8A, a subtitle 814 may occur in non-picture portion 812-2. When the brightness of the non-picture portion 812-2 is adjusted, the brightness of pixels corresponding to the subtitle 814 may be unchanged, thereby preserving the intended content of the subtitle 814. In particular, if the subtitle 814 has a brightness greater than a threshold or a minimum value then the corresponding pixels in the video image already have sufficient headroom to attenuate the noise associated with the display of the video image, such as the noise associated with pulsing of a backlight. Consequently, the brightness of these pixels may be left unchanged or may be modified (as needed) in the same way as pixels in the picture portion 810. However, note that brightness values of pixels associated with the subtitle 814 may be scaled in the same manner as the brightness values of pixels in the picture portion 810 of the video image.

In some embodiments, pixels corresponding to a remainder of the non-picture portion 812-2 are identified based on brightness values in the non-picture portion of the video image that are less than the threshold value. In a temporal data stream of video signals corresponding to the video image, these pixels may be overwritten, pixel by pixel, to adjust their brightness values.

Moreover, the threshold value may be associated with the subtitle 814. For example, if the subtitle 814 is dynamically generated and/or blended with the initial video image, brightness and/or color content associated with the subtitle 814 may be known. Consequently, the threshold may be equal to or related to the brightness values of the pixels in the subtitle 814. In an exemplary embodiment, a symbol in the subtitle 814 may have two brightness values, and the threshold may be the lower of the two. Alternatively or additionally, in some embodiments the component is configured to identify the subtitle 814 and is configured to determine the threshold value (for example, based on the histogram of brightness values). For example, the threshold may be a grayscale level of 180 out of a maximum of 255. Note that in some embodiments rather than a brightness threshold there may be three thresholds associated with color content (or color components) in the video image.

More generally, during the analysis and eventual scaling of the video image, all black pixels or dark regions may be treated the same way (as opposed to treating black pixels in the non-picture portions 812 differently). This includes a dark region 816 in the picture portion 810 of the video image. Note that this technique may provide headroom, in a general way, for dark regions in an image, thereby reducing or eliminating noise associated with light leakage at low brightness values.

Figure 8B:
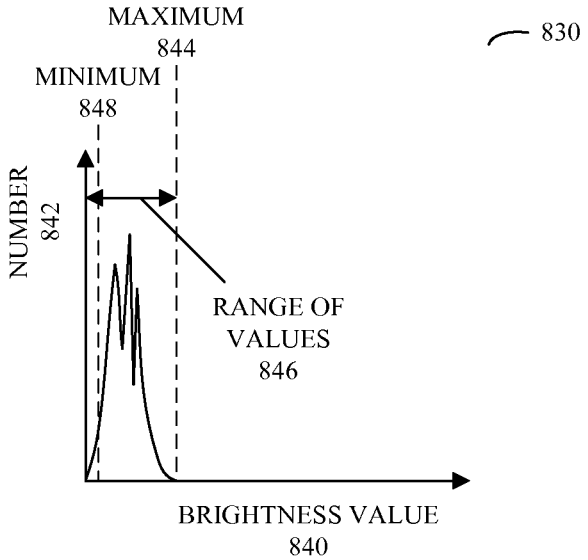
FIG. 8B is a graph illustrating a histogram of brightness values in a video image in accordance with an embodiment of the present invention.

As shown in FIG. 8B, brightness values less than minimum 848 may not be observable when the video image is displayed, for example, because of light leakage in the display. Consequently, on a frame-by-frame basis this provides an opportunity to reduce power consumption and/or to improve the contrast in dark frames. In particular, if the maximum 844 brightness value for the dark region 816 (FIG. 8A) or the video image is lower than the maximum allowed brightness value or a threshold, brightness values in the dark region 816 (FIG. 8A) or the video image can be scaled and the intensity setting of the light source can be reduced, which can make the dark regions in the video image darker, thereby increasing the contrast.

In some embodiments, the threshold is dynamically determined on a frame-by-frame basis based on a metric such as a histogram of brightness values. Additionally, the scaling may be performed on a pixel-by-pixel basis. For example, the brightness values of pixels that have initial brightness values less than the threshold may be scaled.

After the scaling, the maximum brightness value may be greater than the maximum 844. For example, a difference between the new maximum brightness value and the maximum 844 may be at least 1 candela per square meter. This scaling may reduce user-perceived changes in the video image associated with backlighting of the display that displays the video image (for example, it may provide headroom to allow noise associated with pulsing of the backlight to be attenuated).

Alternatively, all black pixels or dark regions may be treated the same way as the remaining pixels in the video image. In particular, dark regions at an arbitrary location in the video image may be scaled to reduce or eliminate noise associated with pulsing or the backlight during transformations or conversions of the video image. For example, an offset associated with light leakage at low brightness values in a given display may be included in a transformation of the video image from the initial brightness domain to the linear brightness domain (for example, using transformation 614-2 in FIG. 6A), and in a transformation of the modified video image from the linear brightness domain to the other brightness domain (for example, using transformation 660-2 in FIG. 6B). Note that while this alternate approach may reduce or eliminate the noise associated with pulsing or the backlight, it may not increase the contrast of the dark regions (unless the offset 616-1 in FIG. 6A is adjusted when the intensity setting is reduced).

In the preceding discussion, characteristics of the light source other than the intensity have been assumed to be unaffected by changes in the intensity setting. However, for some light sources this is not correct. For example, the spectrum of an LED can change as the magnitude of the current driving the LED is adjusted.

Figure 9:
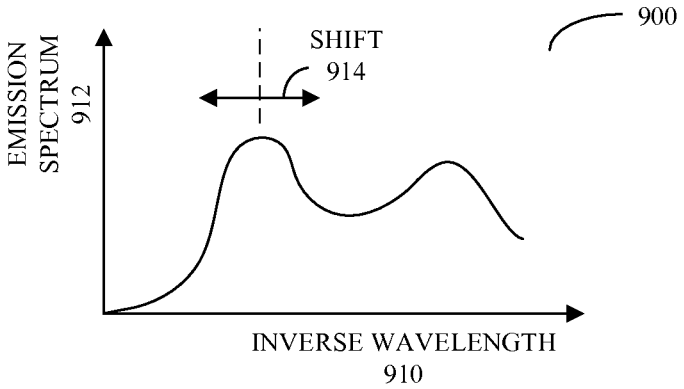
FIG. 9 is a graph illustrating a spectrum of a light source in accordance with an embodiment of the present invention.

This is illustrated in FIG. 9, which presents a graph 900 illustrating an emission spectrum 912 of a light source as a function of inverse wavelength 910. If the intensity setting is reduced there may be a shift 914 in the spectrum. For example, for a white LED, reducing the intensity setting by a factor 3 may lead to a yellow shift in the emission spectrum 912 of 4-10 nm. This change in the emission spectrum 912 is a consequence of band-gap changes associated with band filling. It corresponds to a change in the corresponding black-body temperature of approximately 300 K, which is noticeable to the human eye. Moreover, as a consequence of the shift 914, the combination of the color content in the video image and the emission spectrum 912 do not yield a constant grayscale.

In some embodiments, the color content of the video image is adjusted after the intensity setting and/or the scaling of the brightness values in the video image are determined to correct for this effect. For example, the blue component (in an RGB format) may be increased to correct for yellowing of the emission spectrum 912 as the intensity setting is reduced based on a dependence of the emission spectrum 912 of a given light source on the intensity setting (e.g., the color content may be adjusted based on a characteristic of the given light source). In the linear brightness domain, the shift 914 may result in a 5% change in the color white. Consequently, after the inverse transformation to the other brightness domain, the necessary adjustment in the color content may be approximately 2.5%.

In this way, the overall color white may be unchanged. For example, the color white may be maintained to within approximately 100 K or 200 K of a corresponding black-body temperature associated with the color of the video image prior to changes in the intensity setting. Moreover, the color content may be adjusted so that a product of the color values associated with the video image and the emission spectrum 912 results in an approximately unchanged grayscale for the video image.

Note that the adjustment to the color content in the video image may be generalized to any color using ratios, such as the ratio of R/G and G/B in the RGB format. Moreover, in some embodiment changes to the emission spectrum 912 are avoided or are reduced by adjusting the intensity of the light source using duty-cycle modulation (e.g., pulse width modulation) as opposed to changing the magnitude of the current driving an LED.

Additionally, the adjustment of the color content may be performed in the initial brightness domain or in the linear brightness domain (e.g., after the transformation 514 in FIG. 5). Note that the color adjustment may be performed on a pixel-by-pixel basis.

In the preceding discussion, the techniques have been independent of the resolution and/or the panel size of the display. However, in some mobile products displays have high resolution (e.g., high dpi) and a small panel size. Moreover, some of these displays add a white color filter for some pixels (e.g., by eliminating a color filter for these pixels) in additional to having pixels associated with one or more additional color filters. This configuration can facilitate higher transmittance (and, in general, lower power consumption).

In principal, the presence of the white color filter can dilute the colors in the video image. However, this is typically only a concern for those pixels that are color saturated. In this circumstance, the pixels associated with the white color filter in the color saturated regions of the video image can be selectively adjusted and the intensity setting of the light source can be increased based on the selectively adjusted pixels. Note that selective adjusting of at least some of the pixels associated with the white color filter may be over a range of values and/or may be discrete (such as disabling or enabling at least some of the pixels). As discussed previously, for some light sources (such as LEDs) this change in the intensity setting can lead to a blue shift in the emission spectrum 912. Additionally, the selective adjusting may result in changes in the color content of the video image.

Consequently, in embodiments that include this type of display, the color content in at least a saturated portion of the video image may be suitably modified (for example, the blue component may be reduced) to correct for either or both of these effects. In particular, the adjustment of the color content may correct for a dependence of the emission spectrum 912 of the light source on the intensity setting and/or may correct for color content changes associated with the selective adjusting of the pixels associated with the white color filter. Note that the modification of the color content may be based on the color saturation in at least a portion of the video image.

Once again, the color content may be modified to maintain the overall color white (for example, to within approximately 100 K or 200 K of a corresponding black-body temperature associated with the color of the video image prior to changes in the intensity setting) and/or to result in an approximately unchanged grayscale for the video image. Moreover, the adjustment of the color content in the video image may be performed on a pixel-by-pixel basis.

One challenge associated with this technique can occur when a user is viewing a web page. In particular, while text is not typically a problem, when the user views a logo (which is typically highly color saturated) some white color pixels will be turned off and the intensity setting of the light source will be increased. As these adjustments occur, the perceived color of the white background on the web page needs to be unchanged (in general, users are very sensitive to changes in the white background). However, because it is sometimes difficult to match components, when a sudden adjustment is made in the intensity setting a brightness change (or flicker) in the white background as large as 3% can occur (which the user will notice).

In some embodiments, this challenge is addressed using frame buffers and anticipating future adjustments. In this way, the intensity setting may be adjusted more slowly (e.g., may be pre-adjusted) before a logo or a color saturated region is displayed. For example, a full web page may be stored in memory, even if the user is only viewing a subset of the web page. Then, the movement direction may be predicted (for example, using motion estimation) to determine when regions with highly saturated colors may occur (in the future) and to use this information to mask a jump in the brightness value by incrementally applying the changes to the intensity setting across at least a subset of a sequence of video images associated with the web page. In an exemplary embodiment, where 30-50 frames are being viewed at 60 frames/second, the intensity setting of the light source may be adjusted over 0.5 second (as opposed to over 1/20 to 1/60 of a second). Note that by using this approach in conjunction with the preceding techniques, power consumption can be reduced even when the background in the given video image is white, without producing artifacts.

Figure 10:
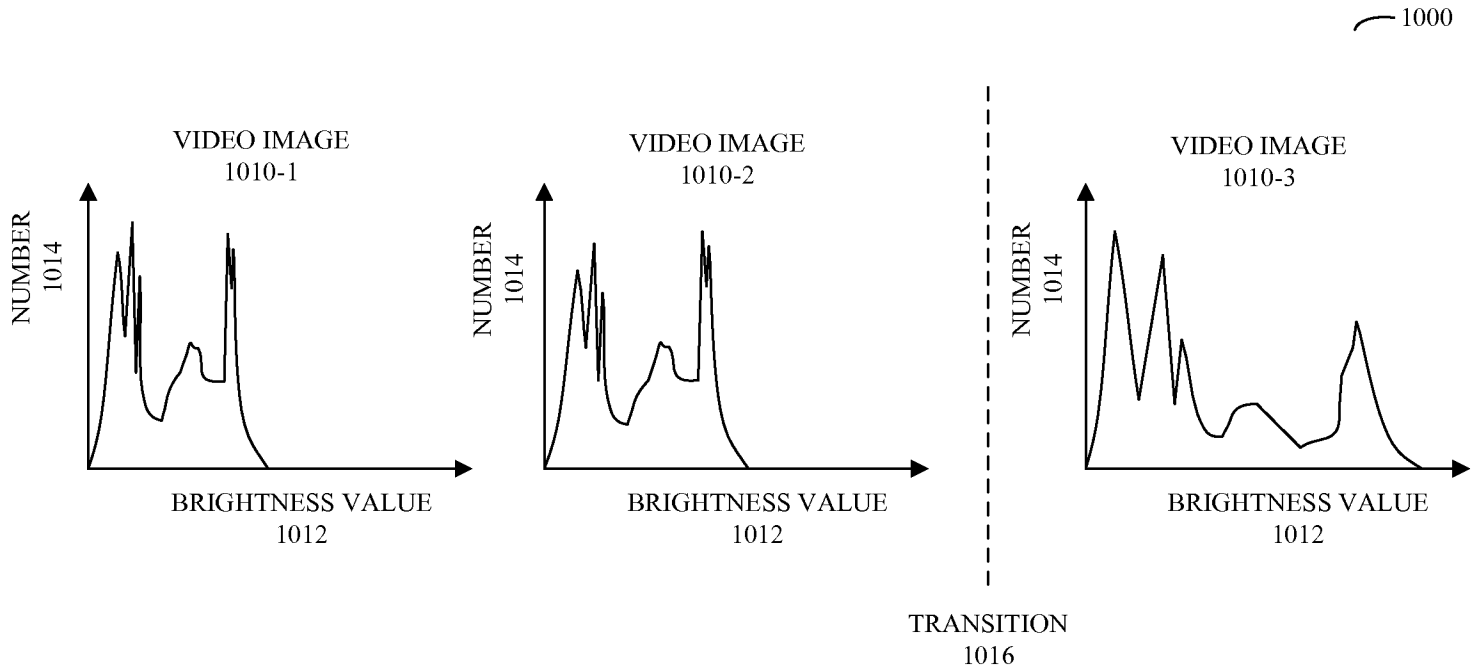
FIG. 10 is a sequence of graphs illustrating histograms of brightness values for a sequence of video images in accordance with an embodiment of the present invention.

Filtering of the intensity setting 718 (FIGS. 7A and 7B) in a sequence of video images in accordance with embodiments of the invention is now further described. FIG. 10 presents a sequence of graphs 1000 illustrating an embodiment of histograms of brightness values for video images 1010, plotted as a number 1014 of counts as a function of brightness value 1012, for a received sequence of video images (prior to any scaling of the video signals). Transition 1016 indicates the large change in the peak value of the brightness in the histogram for video image 1010-3 relative to the histogram for video image 1010-2. As described previously, in some embodiments temporal filtering of the intensity setting 718 (FIGS. 7A and 7B) is disabled when such a large change occurs, thereby allowing the full brightness change to be displayed in the current video image.

In some embodiments, changes to the intensity setting and scaling of the brightness values may be applied opportunistically. This may be useful if there are large changes and/or scaling, a visual artifact (such as flicker) that can be perceived by users may occur. For example, a face in the foreground of a given video image with a changing background may exhibit flicker as the background changes, especially when the background becomes brighter because, in this case, the transitions time constants associated with changes in the intensity setting of the backlight may be very short.

To address this challenge, a brightness metric, such as a histogram of brightness values with 64 bins or brightness-value intervals, may determined for each video image in a sequence of video images (for example, in at least a 1-frame feed-forward architecture), and the resulting brightness metrics may be analyzed to identify locations (such as transition 1016) where there is a discontinuity in the brightness metrics for two adjacent video images (such as video images 1010-2 and 1010-3). For example, the discontinuity may include a change in a maximum brightness value in the histograms of brightness values that exceeds a predetermined value, such as a 1-10% change. This discontinuity may be associated with content changes in the sequence of video images (such as a scene change). By opportunistically applying the changes to the intensity setting and scaling the brightness values at these locations, users may not perceive the visual artifact because flicker will be masked by the content changes.

In an exemplary embodiment, when the change in histograms for adjacent video images is large for most brightness-value intervals, it is likely that there has been a scene change. Such as scene change may be determined by defining metrics that tell us how much the histogram has changed as a function of time. For example, when there is a change in a given brightness-value interval greater than the predetermined value, this interval may be identified as one having a 'substantial change.' One indication (or metric) of a discontinuity in the histograms may be determined by counting the number of brightness-value intervals with substantial changes. Another indication (or metric) of a discontinuity in the histograms may be the average change in the subgroup of brightness-value intervals with substantial changes.

This technique may be generalized, because mid-level grays and bright-clipped values can play a different role in inducing flicker. Consequently, in a more fine-tuned approach there may be a different threshold value for each brightness-value interval or weight factors (scaling factors) may be applied to each brightness-value interval before calculating the average or before counting the intervals.

In an exemplary embodiment (without weight factors), the histogram for the given video image may be determined using 64 brightness-value intervals. If more than e.g. half of these brightness-value intervals have substantial changes then there may be a discontinuity between the histograms for adjacent video images (i.e., the histogram for the given video image may have changed significantly from that of the previous video image). In another embodiment, the histogram for the given video image may be determined using 3-5 larger brightness-value intervals. If at least all but one of these brightness-value intervals had a substantial change, then the histogram would be deemed to have a strong change.

Opportunistic adjustments at the discontinuity may be used separately or in conjunction with routine adjustments that are applied to the given video image in the sequence of video images even when there is no discontinuity. For example, a portion of the change in the intensity setting and the associated scaling of the brightness values may be applied to the given video image using systematic under-relaxation (which may be implemented via a temporal filter, such as optional filter/driver circuit 758 in FIG. 7B). Moreover, when there is a discontinuity, the time constant of the temporal filter may be changed (for example, it may be reduced), such that larger changes in the intensity setting and scaling of the brightness values may be applied to the subsequent video image. In this way, differences in the intensity setting and/or the scaling of the brightness values between adjacent video images may be less than another predetermined value (such as 10, 25 or 50%) unless there is a discontinuity between these video images, in which case the differences in the intensity setting and/or the scaling of the brightness values may be greater than the other predetermined value.

Note that a transition time constant for the change in the intensity setting of the backlight may be adaptive. Additionally, the transition time constant may depend on the direction of the change (for example, from darker to brighter) and/or a magnitude of the intensity-setting change. For example, the transition time constant may be between 0 and 5 frames on a 60 Hz video pipeline when the intensity setting is increased, and may be between 8 and 63 frames when the intensity setting is reduced. Additionally, note that the transition time constant for the intensity setting of the backlight may also be the time constant for scaling of brightness values of pixels in the given video image because the brightness values of the pixels may be modified synchronously with the intensity setting.

In an exemplary embodiment, metrics associated with changes in the histogram for the given video image, such as the number of brightness-value intervals with a substantial change, is used to determine the transition time constant. Note that if there is a change in the sequence of video images, analysis circuit 746 (FIG. 7B) may determine that the intensity setting of the backlight can be changed. However, adjustment circuit 748 (FIG. 7B) may be more influenced by brighter parts of the histogram or the shape of the histogram when determining the new intensity setting.

Moreover, a larger change in the intensity setting can occur with or without a large change in the histograms of brightness values. These two circumstances can be distinguished using the afore-mentioned indicators or metrics, i.e., analysis of the histogram of brightness values. Thus, even if the new intensity setting is approximately the same when there are substantial changes in the histogram of brightness values between adjacent video images or when there are little (or minor) changes in the histogram of brightness values, different transition time constants can be used for these two circumstances (for example, the transition time constant may be smaller when there are substantial changes).

In general, the transition time constant may be a monotonic function (e.g., a simple inverse function) of the one or more histogram-change metrics or indicators. For example, the transition time constant may be shorter when there is a large change in the histogram and vice versa.

In some embodiments, an error metric may be calculated for a portion or all of the given video image. This error metric may be used to evaluate determined changes to the intensity setting and/or the scaling of the brightness values (e.g., after these adjustments have been determined). For example, the error metric may be determined using the analysis circuit 746 in FIG. 7B. Alternatively, the error metric may be calculated while the changes to the intensity setting and/or the scaling of the brightness values. Consequently, in some embodiments the changes to the intensity setting and/or the scaling of the brightness values are determined, at least in part, based on the error metric.

In particular, the error metric may be based on the scaled brightness values and the given video image (prior to the scaling of the brightness values), and may be determined on a pixel-by-pixel basis in the given video image. For example, a contribution of a given pixel to the error metric may correspond to a ratio of brightness value after the scaling to an initial brightness value before the scaling. Note that in general this ratio is greater than or equal to 1. Moreover, if this ratio is larger than 1, an error has occurred for the given pixel during the determination of the scaling.

Note that this error metric may be used (for example, in a feedback loop) to determine if the adjustments associated with the given video image (such as the scaling of the brightness values) may result in distortion or user-perceived visual artifacts when the given video image is displayed. For example, reduced contrast or loss of detail in at least a portion of the video image may be determined when the average error metric for the given video image exceeds an additional predetermined value (such as 1). If yes, the scaling of at least some of the brightness values and/or the change to the intensity setting may be reduced (for example, using adjustment circuit 748 in FIG. 7B). Moreover, this reduction in the scaling of the brightness values may be performed on a pixel-by-pixel basis.

In some embodiments, there may be a region in the video image in which contributions from each of the pixels exceed the additional predetermined value. For example, the region may include pixels having brightness values exceeding a threshold (such as a brightness value of 0.5-0.8 relative to a maximum of 1 in the linear space) that is surrounded by pixels having brightness values less than the threshold. This region may be susceptible to distortion, such as that associated with reduced contrast when the brightness values are scaled. To reduce or prevent such distortion, the scaling of the brightness values in this region may be reduced. For example, the reduction may at least partially restore the contrast in the region.

Note that in some embodiments that region may be identified without calculating the error metric or using additional metrics in conjunction with the error metric. For example, the region may be identified if it has a certain number of pixels having brightness values exceeding the threshold (such as 3, 10 or 20% of the number of pixels in the video image). Alternatively, the region having pixels with brightness values exceeding the threshold may be identified by a certain size of the region.

Moreover, if the scaling of the brightness values is reduced, the given video image may be spatially filtered to reduce a spatial discontinuity between the brightness values of pixels within the region and the brightness values in a remainder of the given video image.

In an exemplary embodiment, the mapping function used to scale the brightness values (such as the mapping function 310 in FIG. 3) has two slopes (such as slopes 316 in FIG. 3). One slope is associated with dark and medium gray pixels and another, reduced slope (e.g., ⅓) for pixels having bright input brightness values (before the scaling. After the scaling, note that the contrast of pixels associated with the reduced slope is decreased. By selectively applying a local contrast enhancement to a portion of the video image, such as the region, user perception of visual artifacts may be reduced or eliminated. For example, spatial processing with a frame may be used to locally restore the original slope in a mapping function applied to pixels in the region. Consequently, there may be more than one mapping function for the given video image. Additionally, spatial filtering may be applied to ensure a smooth transition of intermediate states between pixels associated with one mapping function and pixels associated with another mapping function.

Note that local contrast enhancement may be a small-scale local contrast enhancement, such as edge sharpening (in which spatial processing is performed on in the vicinity or neighborhood of a few pixels), or may be local contrast enhancement of a small region (which is on a larger scale, but which is still small compared to the size of the given video image). For example, this larger scale local contrast enhancement may be performed on a region that includes between less than 1% and 20% of the pixel count in the given video image.

This local contrast enhancement may be implemented in several ways. Typically, the calculations are performed in the linear space where the brightness value of a given pixel is proportional to the radiant-power value. In one implementation, pixels associated with a reduced slope in the mapping function may be identified. Next, a blur function (such as Gaussian blur) may be applied to these pixels. In some embodiments, prior to applying this blur function, it is confirmed that either these pixels have a scalable value (associated with the scaling of the brightness values) of greater than 1 or an intermediate video image in which the scalable value of these pixels is greater than or equal to 1 is determined.

Then, another intermediate video image (for use in internal processing) may be determined. This intermediate image that has a scalable value of greater than 1 in the blurred region and a scalable value equal to 1 in the remainder of the given video image.

Moreover, the original video image may be divided by the other intermediate video image. In most portions of the given video image, the division will be by 1 (i.e., there has been no change relative to the original video image). Consequently, the brightness values in the region in the original video image will be reduced and the total brightness range of the new version of the video image is also reduced (e.g., pixel brightness values range from 0 to 0.8 as opposed to 0 to 1 in the original video image). Note that if the blur function is chosen correctly, the local contrast in the region is almost unchanged in spite of the compression.

Having determined a new version of the given video image with a reduced range of brightness values, the amount of reduction in the brightness range can be selected. If the goal is to reduce the intensity setting of the backlight by a factor of, for example, 1.5, the range of brightness values in the new version of the given video image will be a factor of 1.5 lower than 1 (the maximum brightness value of the pixels). Consequently, the brightness value of the brightest point in the new version of the given video image is, in this example, 1/1.5. By using this technique, the local contrast can be preserved almost everywhere in the given video image. While the global contrast may be slightly reduced, a reduction by a factor of 1.5 in global contrast is a very small effect for the human eye.

Note that in some embodiments, the range of brightness values is reduced by scaling the entire video image without local processing. However, in this case, the local contrast may be affected in the entire video image and not just in the region.

Next, the new version of the video image may be used as an input to another mapping function, which is different that the mapping function that was already applied to the given video image. This other mapping function may not have the reduced slope. For example, the other mapping function may scale the brightness values of all pixels by a factor of 1.5. Consequently, the other mapping function may be a linear function with slope of 1.5. As a result the output video image may have increased brightness values for all of the pixels except those in the region, which will allow the intensity setting of the backlight to be reduced by a factor of 1.5.

In summary, in this implementation almost all pixels maintain their brightness values as in the original video image. Moreover, while the brightness values of the pixels in the region are not maintained, the local contrast in this region is maintained.

In a variation on this implementation, a more general approach is used. In particular, the global contrast may be reduced not only for those pixels that have high brightness values, but equally for all pixels. In the process, local contrast will be preserved. A wide variety of techniques are known in the art for reducing the global contrast (for example, by a factor of 1.5) without affecting the local contrast.

After this operation, the resulting video image may be scaled, for example, by a factor of 1.5. Consequently, the average of the brightness values of the pixels in the given video image will be increased or scaled, which allows the intensity setting of the backlight to be reduced. Note that while the given video image will (overall) have higher brightness values, the local contrast will be approximately unaffected.

In another implementation, pixels associated with the reduced slope in the mapping function are identified. Next, a sharpening technique may be applied to these pixels. For example, the sharpening technique may include: a so-called 'unsharpen filter' (which makes edges more pronounced), matrix kernel filtering, de-convolution, and/or a type of non-linear sharpening technique. After the contrast enhancement, the mapping function may be applied to these pixels, where the improved edge contrast will be reduced to a level similar to that in the video original image.

Note that the sharpening technique or, more generally, the local contrast enhancement may be applied to these pixels before the mapping function is applied. This may improve digital resolution. However, in some embodiments the sharpening technique may be applied to the identified pixels after the mapping function has been applied to these pixels.

In summary, in this implementation the brightness values of all of the pixels in the given video image are maintained in spite of the factor of 1.5 reduction in the intensity setting of the backlight. While the brightness values of the pixels in the region are not maintained, the edge contrast is maintained in this region.

In yet another implementation, instead of using one or more fixed mapping functions for the given video image, a spatially changing mapping function may be used, where, in principle, each pixel may have its own associated mapping function (e.g., a local-dependent mapping function is a function of x, y and the brightness value of the input pixel). Moreover, there may be pixels associated with the region and pixels associated with the remainder of the given video image. These two groups of pixels are not separable. In particular, there may be a smooth transition of intermediate states between them, via, the location-dependent mapping function.

Note that the intent of the location-dependent mapping function is to keep the slope associated with pixels in the neighborhood of a given pixel around 1. In this way, there is no reduction in the local contrast. For all other pixels (say 90% of the pixels in the given video image, the location-dependent mapping function may be the same as the (fixed) mapping function, except at the boundary or transition between pixels in the region and pixels in the remainder. This transition usually is non-monotonic with respect to the brightness value of the input pixel. However, with respect to x and y, this transition is smooth, i.e., continuous.

Figure 11A:
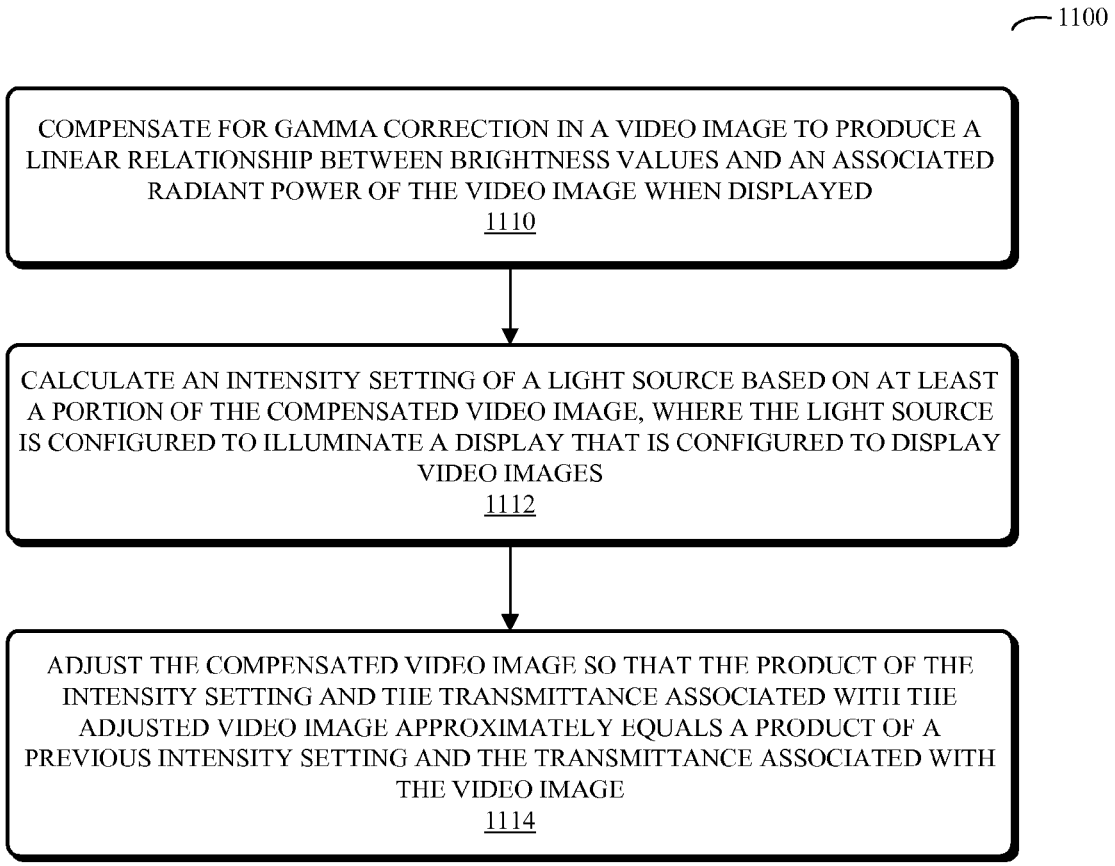
FIG. 11A is a flowchart illustrating a process for adjusting a video image in accordance with an embodiment of the present invention.

Processes associated with the above-described techniques in accordance with embodiments of the invention are now described. FIG. 11A presents a flowchart illustrating a process 1100 for adjusting a video image, which may be performed by a system. During operation, this system compensates for gamma correction in a video image to produce a linear relationship between brightness values and an associated radiant power of the video image when displayed (1110). For example, after compensation, a domain of the brightness values in the video image may include range of brightness values corresponding to substantially equidistant adjacent radiant-power values in a displayed video image.

Next, the system calculates an intensity setting of a light source based on at least a portion of the compensated video image (1112), where the light source is configured to illuminate a display that is configured to display video images. Then, the system adjusts the compensated video image so that the product of the intensity setting and the transmittance associated with the adjusted video image approximately equals the product of the previous intensity setting and the transmittance associated with the video image (1114).

Figure 11B:
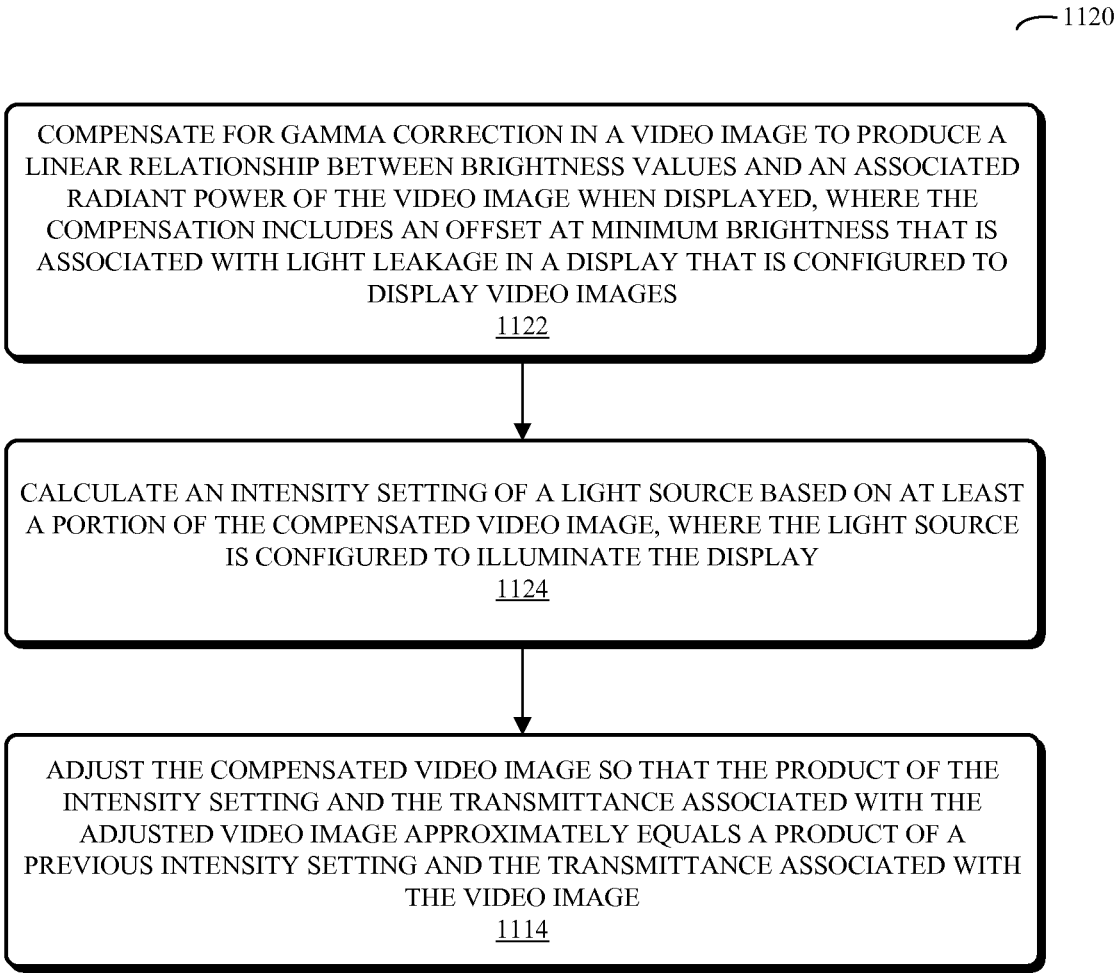
FIG. 11B is a flowchart illustrating a process for adjusting a brightness of pixels in a video image in accordance with an embodiment of the present invention.

FIG. 11B presents a flowchart illustrating a process 1120 for adjusting a brightness of pixels in a video image, which may be performed by a system. During operation, this system compensates for gamma correction in a video image to produce a linear relationship between brightness values and an associated radiant power of the video image when displayed (1122), where the compensation includes an offset at minimum brightness that is associated with light leakage in a display that is configured to display video images. For example, after compensation, a domain of the brightness values in the video image may include range of brightness values corresponding to substantially equidistant adjacent radiant-power values in a displayed video image.

Next, the system calculates an intensity setting of a light source based on at least a portion of the compensated video image (1124), where the light source is configured to illuminate the display. Then, the system adjusts the compensated video image so that the product of the intensity setting and the transmittance associated with the adjusted video image approximately equals the product of the previous intensity setting and the transmittance associated with the video image (1114).

In an exemplary embodiment, pixels in an arbitrary portion of the video image having brightness values less than the threshold or brightness values near a minimum brightness values are scaled. This scaling can reduce user perception of noise associated with pulsing of the light source. For example, the new brightness values may provide headroom to attenuate or reduce perception of this noise.

Figure 11C:
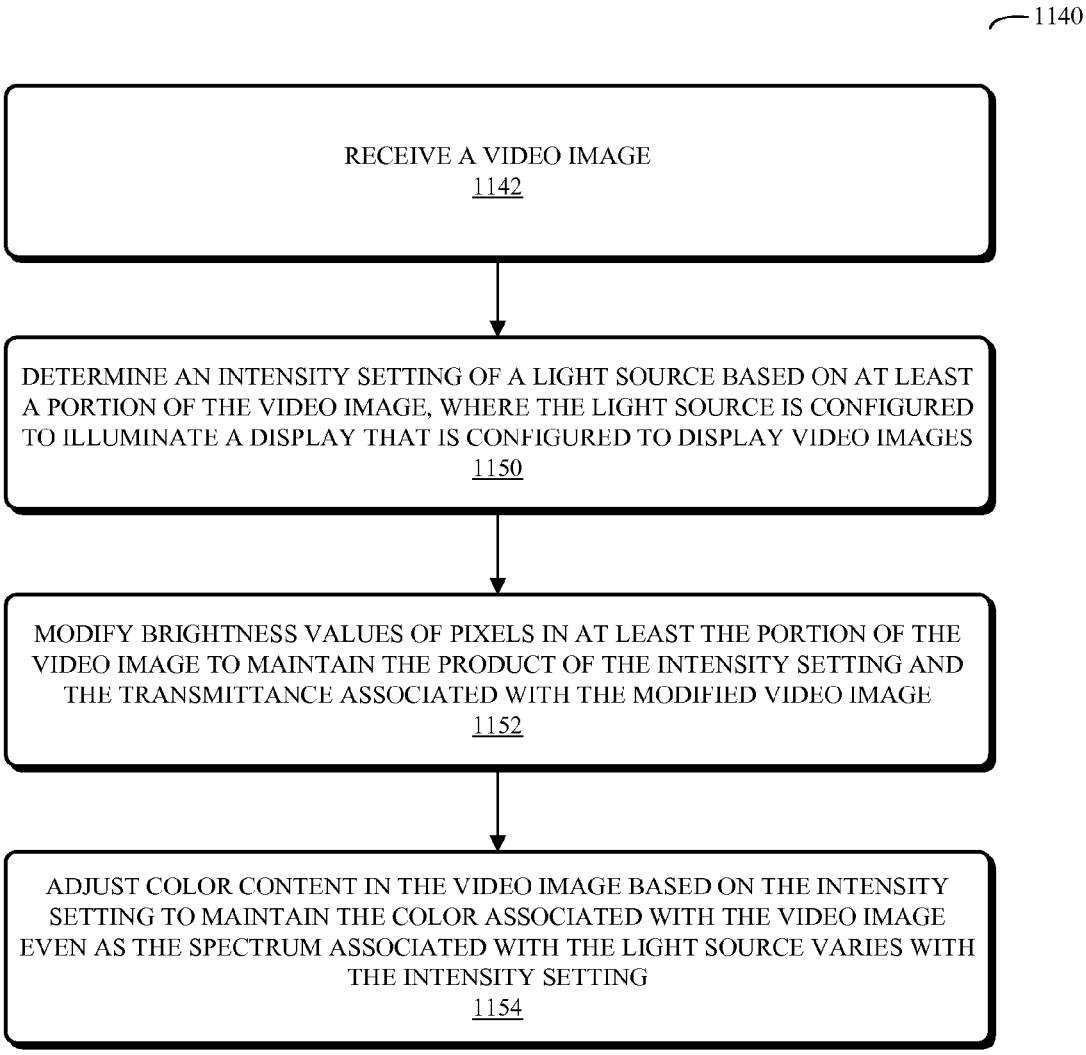
FIG. 11C is a flowchart illustrating a process for adjusting a video image in accordance with an embodiment of the present invention.

FIG. 11C presents a flowchart illustrating a process 1140 for adjusting a video image, which may be performed by a system. During operation, this system receives a video image (1142) and determines an intensity setting of a light source based on at least a portion of the video image (1150), where the light source is configured to illuminate a display that is configured to display video images. Next, the system modifies brightness values of pixels in at least a portion of the video image to maintain the product of the intensity setting and the transmittance associated with the modified video image (1152). Then, the system adjusts color content in the video image based on the intensity setting to maintain the color associated with the video image even as the spectrum associated with the light sources varies with the intensity setting (1154).

Figure 11D:
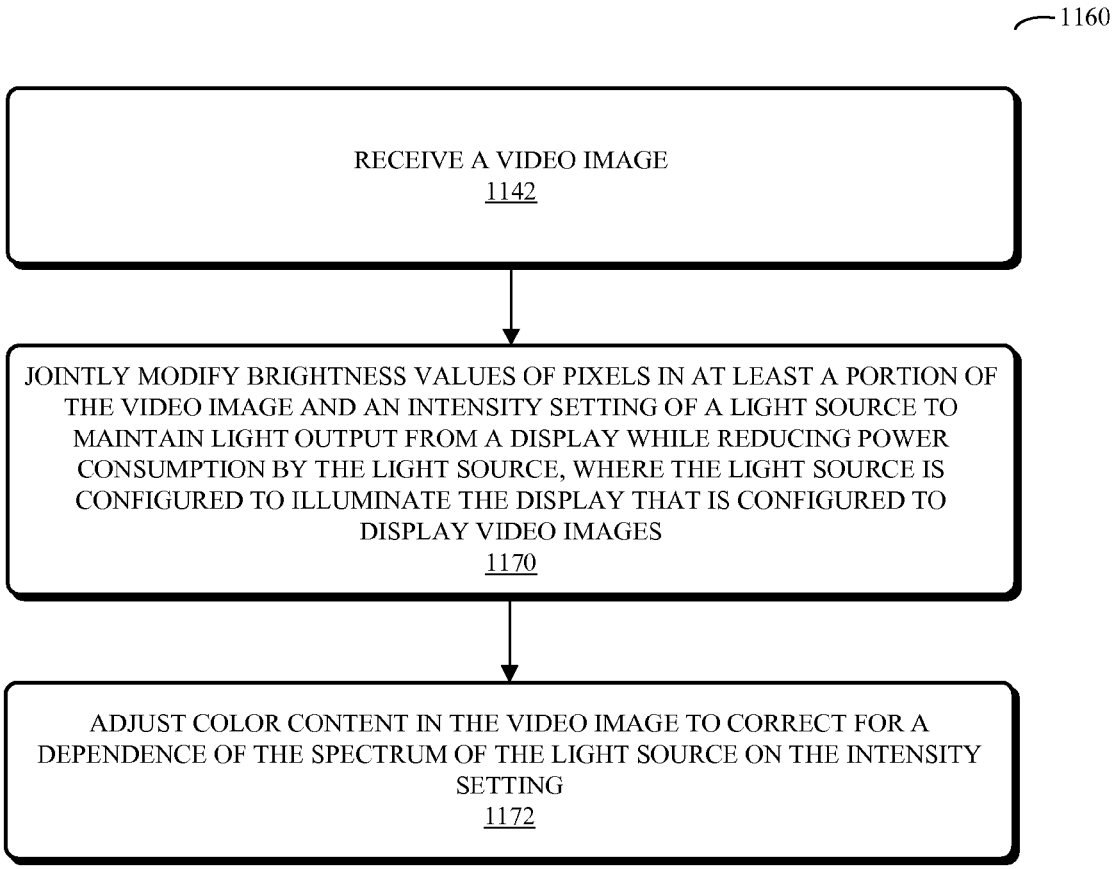
FIG. 11D is a flowchart illustrating a process for adjusting a video image in accordance with an embodiment of the present invention.

FIG. 11D presents a flowchart illustrating a process 1160 for adjusting a video image, which may be performed by a system. During operation, this system receives a video image (1142). Next, the system jointly modifies brightness values of pixels in at least a portion of the video image and an intensity setting of a light source to maintain light output from a display while reducing power consumption by the light source (1170), where the light source is configured to illuminate the display that is configured to display video images. Then, the system adjusts color content in the video image to correct for a dependence of the spectrum of the light source on the intensity setting (1172).

In an exemplary embodiment, the color adjustment is based on a characteristic of the light source (such as the dependence of the spectrum on the intensity setting). Additionally, the color adjustment may maintain the color white. For example, the color may be adjusted so that a product of the color values associated with the video image and the spectrum results in an approximately unchanged grayscale for the video image. Moreover, the color white may be maintained to within approximately 100 K or 200 K of a corresponding black-body temperature associated with the color of the video image prior to changes in the intensity setting. In some embodiments, the color adjustment may include increasing a blue-color component in the video image when the intensity setting is reduced relative to a previous intensity setting and may include decreasing the blue-color component in the video image when the intensity setting is increased relative to the previous intensity setting.

Figure 11E:
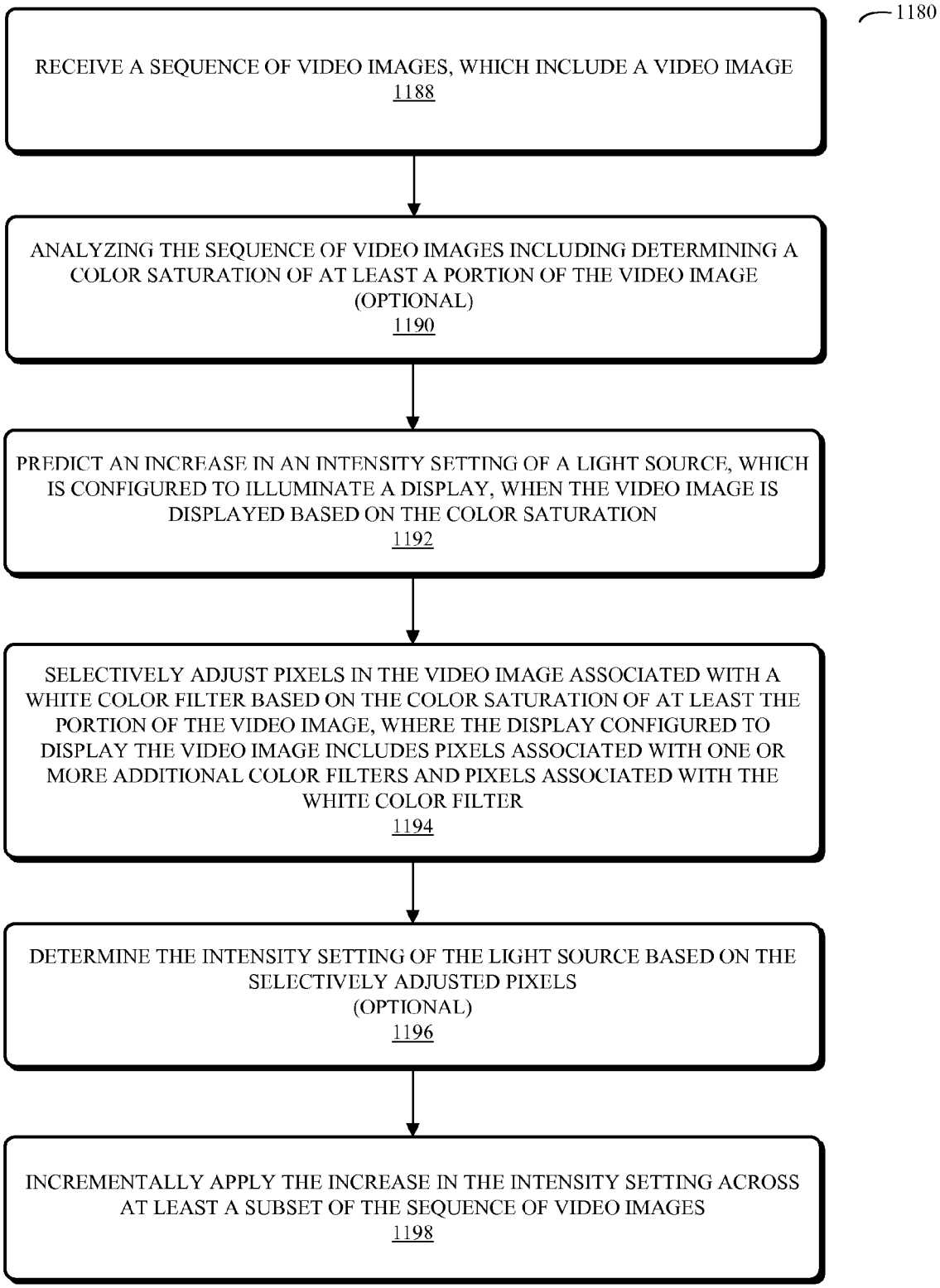
FIG. 11E is a flowchart illustrating a process for adjusting a video image in accordance with an embodiment of the present invention.

FIG. 11E presents a flowchart illustrating a process 1180 for adjusting a video image, which may be performed by a system. During operation, the system receives a sequence of video images (1188), which include a video image, and optionally analyzes the sequence of video images (1190), including determining a color saturation of at least a portion of the video image. Next, the system predicts an increase in an intensity setting of a light source (1192), which is configured to illuminate a display, when the video image is to be displayed based on the color saturation.

Then, the system selectively adjusts pixels in the video image associated with a white color filter based on the color saturation (1194). Note that a display configured to display the video image includes pixels associated with one or more additional color filters and pixels associated with the white color filter.

In some embodiments, the system optionally determines the intensity setting of the light source based on the selectively adjusted pixels (1196). Moreover, the system incrementally applies the increase in the intensity setting across at least a subset of the sequence of video images (1198).

Figure 12A:
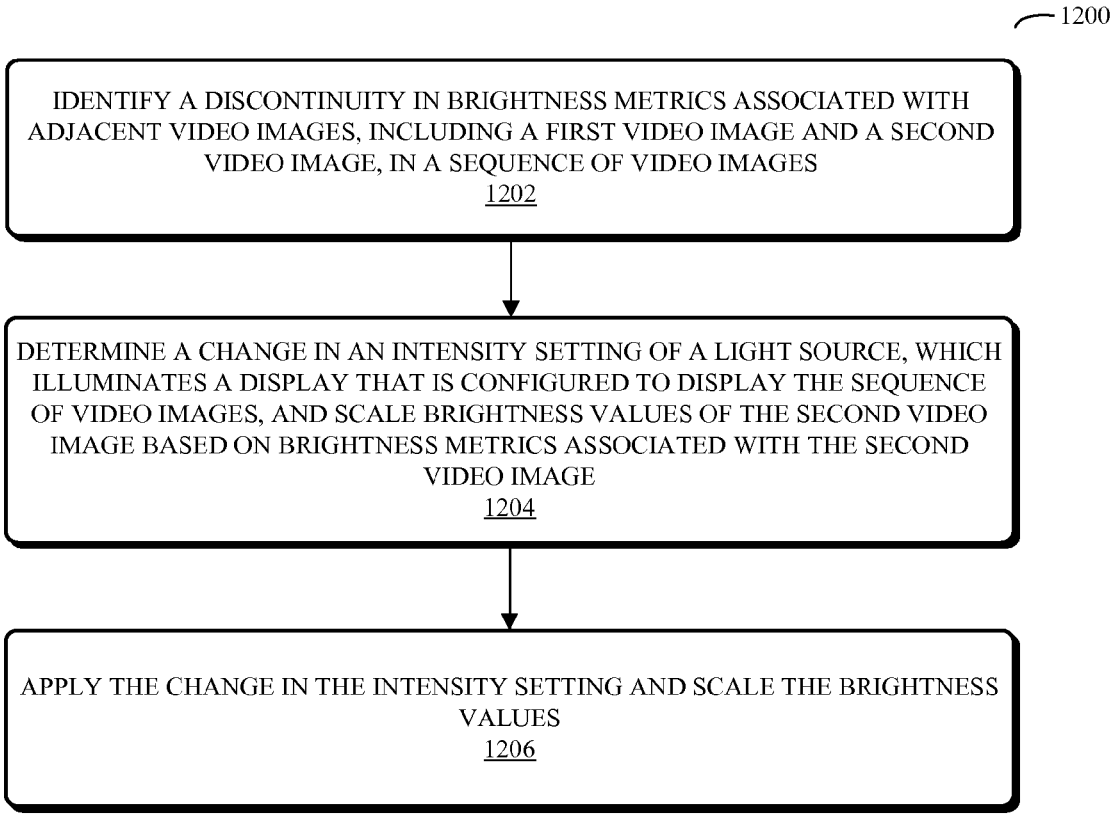
FIG. 12A is a flowchart illustrating a process for adjusting a brightness of a video image in accordance with an embodiment of the present invention.

FIG. 12A presents a flowchart illustrating a process 1200 for adjusting a brightness of a video image, which may be performed by a system. During operation, this system identifies a discontinuity in brightness metrics associated with adjacent video images, including a first video image and a second video image, in a sequence of video images (1202). Next, the system determines a change in an intensity setting of a light source, which illuminates a display that is configured to display the sequence of video images, and scales brightness values of the second video image based on a brightness metric associated with the second video image (1204). Then, the system applies the change in the intensity setting and scales the brightness values (1206).

Figure 12B:
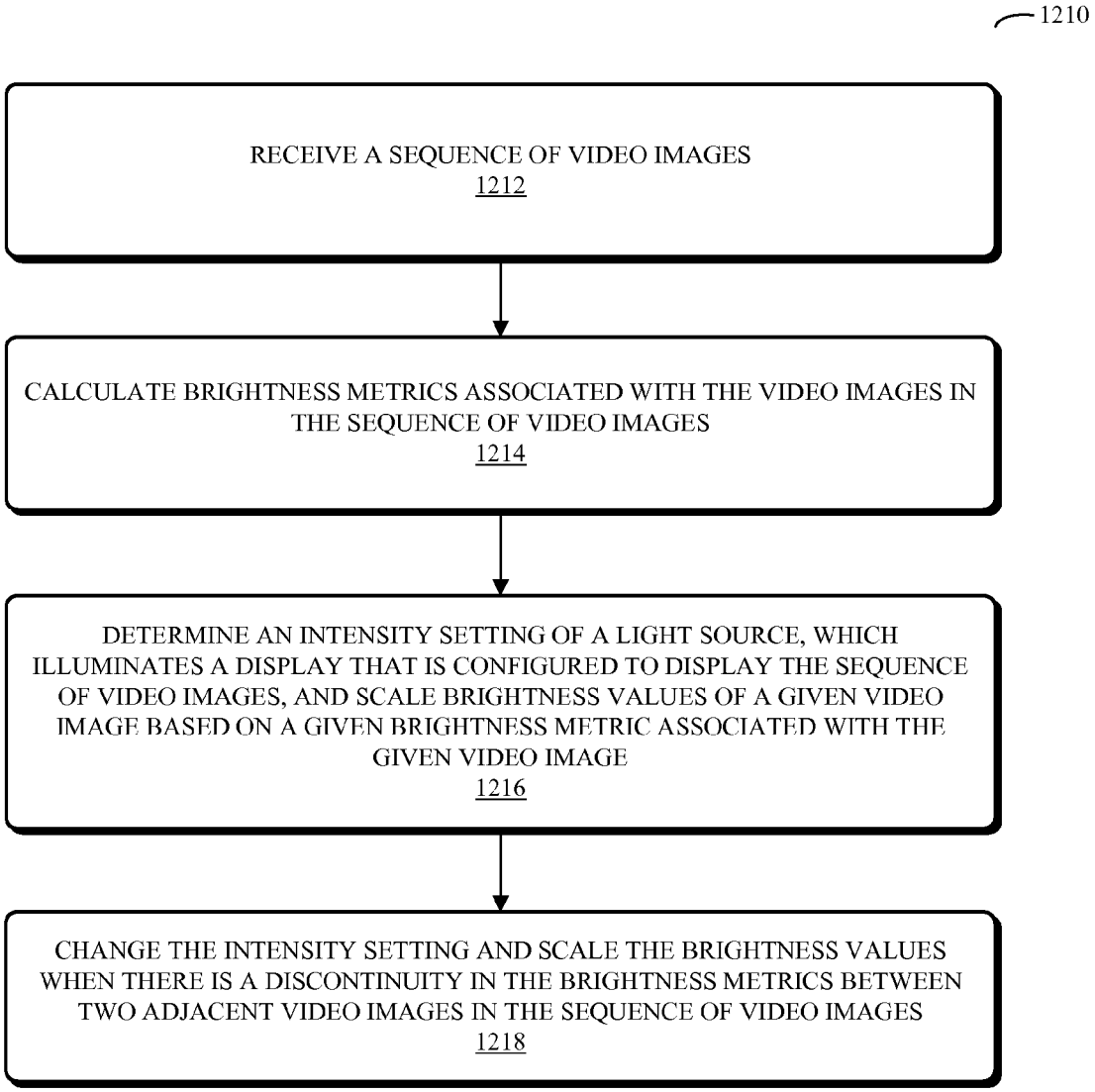
FIG. 12B is a flowchart illustrating a process for adjusting a brightness of a video image in accordance with an embodiment of the present invention.

FIG. 12B presents a flowchart illustrating a process 1210 for adjusting a brightness of a video image, which may be performed by a system. During operation, this system receives a sequence of video images (1212) and calculates brightness metrics associated with the video images in the sequence of video images (1214). Next, the system determines an intensity setting of a light source, which illuminates a display that is configured to display the sequence of video images, and scales brightness values of a given video image in the sequence of video images based on a given brightness metric associated with the given video image (1216). Then, the system changes the intensity setting and scales the brightness values when there is a discontinuity in the brightness metrics between two adjacent video images in the sequence of video images (1218).

Figure 12C:
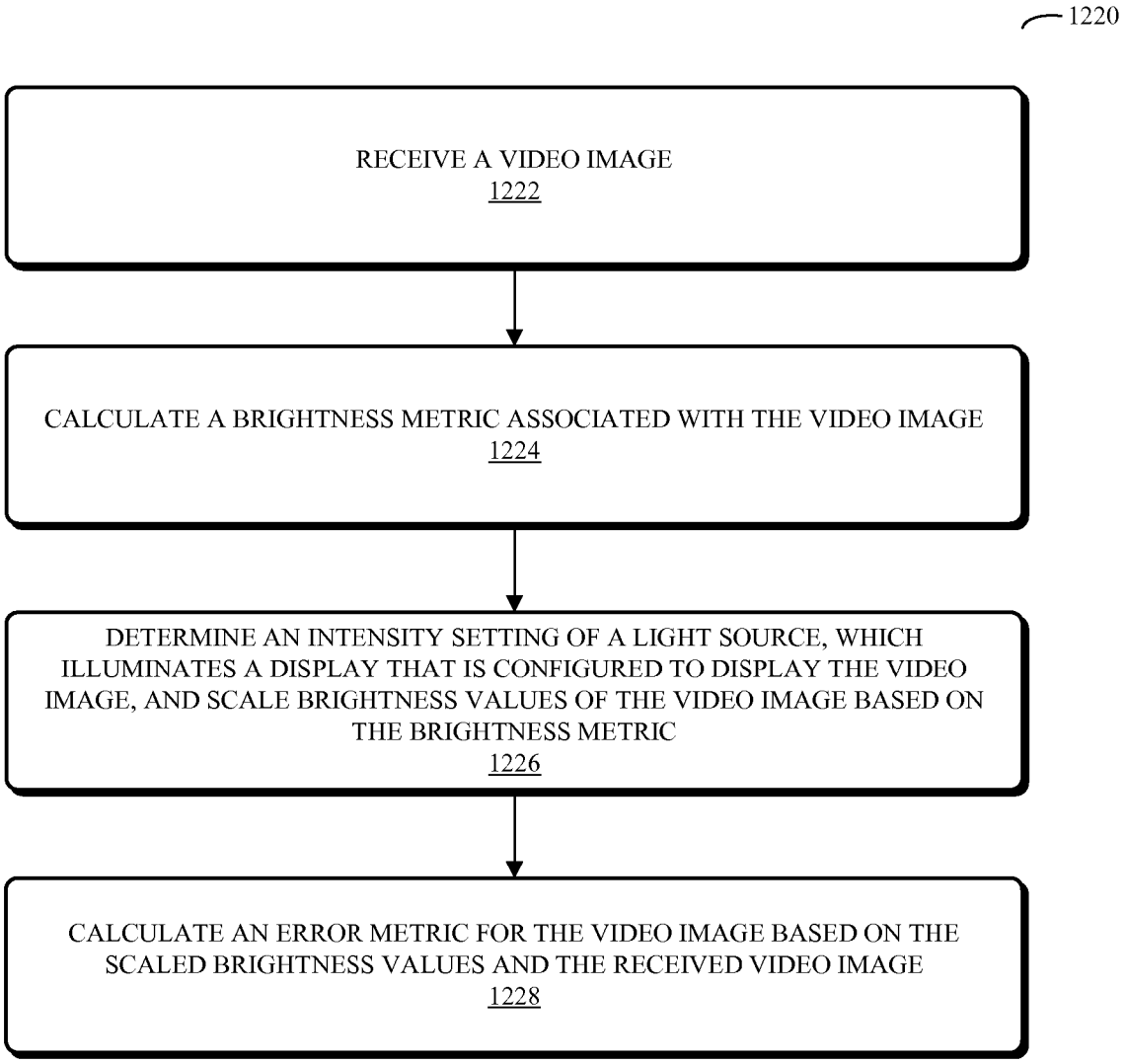
FIG. 12C is a flowchart illustrating a process for calculating an error metric associated with a video image in accordance with an embodiment of the present invention.

FIG. 12C presents a flowchart illustrating a process 1220 for calculating an error metric associated with a video image, which may be performed by a system. During operation, this system receives a video image (1222) and calculates a brightness metric associated with the video image (1224). Next, the system determines an intensity setting of a light source, which illuminates a display that is configured to display the video image, and scales brightness values of the video image based on the brightness metric (1226). Then, the system calculates an error metric for the video image based on the scaled brightness values and the received video image (1228).

Figure 12D:
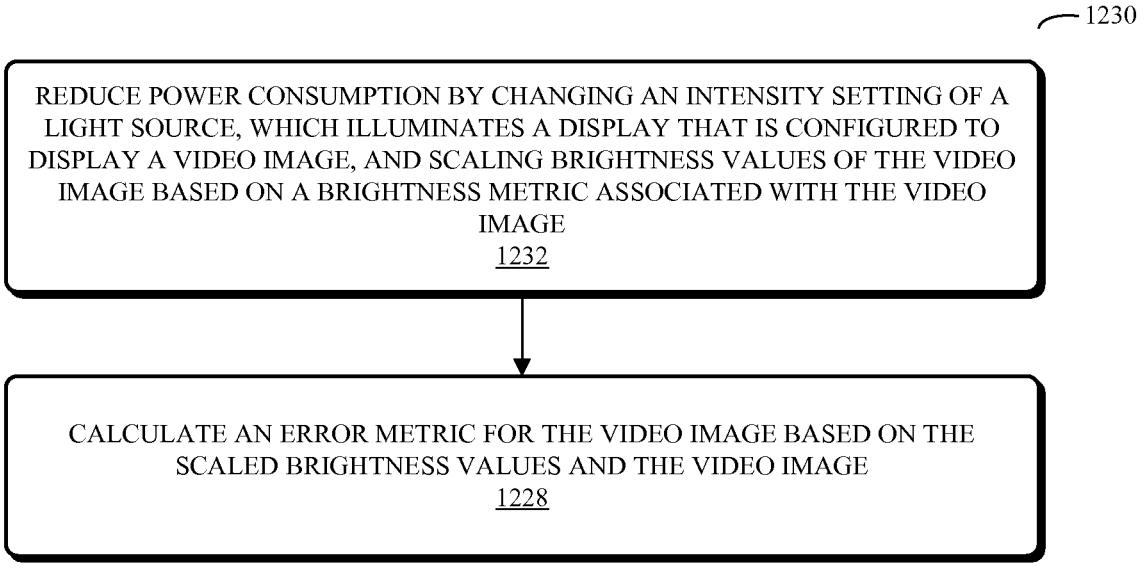
FIG. 12D is a flowchart illustrating a process for calculating an error metric associated with a video image in accordance with an embodiment of the present invention.

FIG. 12D presents a flowchart illustrating a process 1230 for calculating an error metric associated with a video image, which may be performed by a system. During operation, this system reduces power consumption by changing an intensity setting of a light source, which illuminates a display that is configured to display a video image, and scaling brightness values for the video image based on a brightness metric associated with the video image (1232). Next, the system calculates the error metric for the video image based on the scaled brightness values and the video image (1228).

Figure 12E:
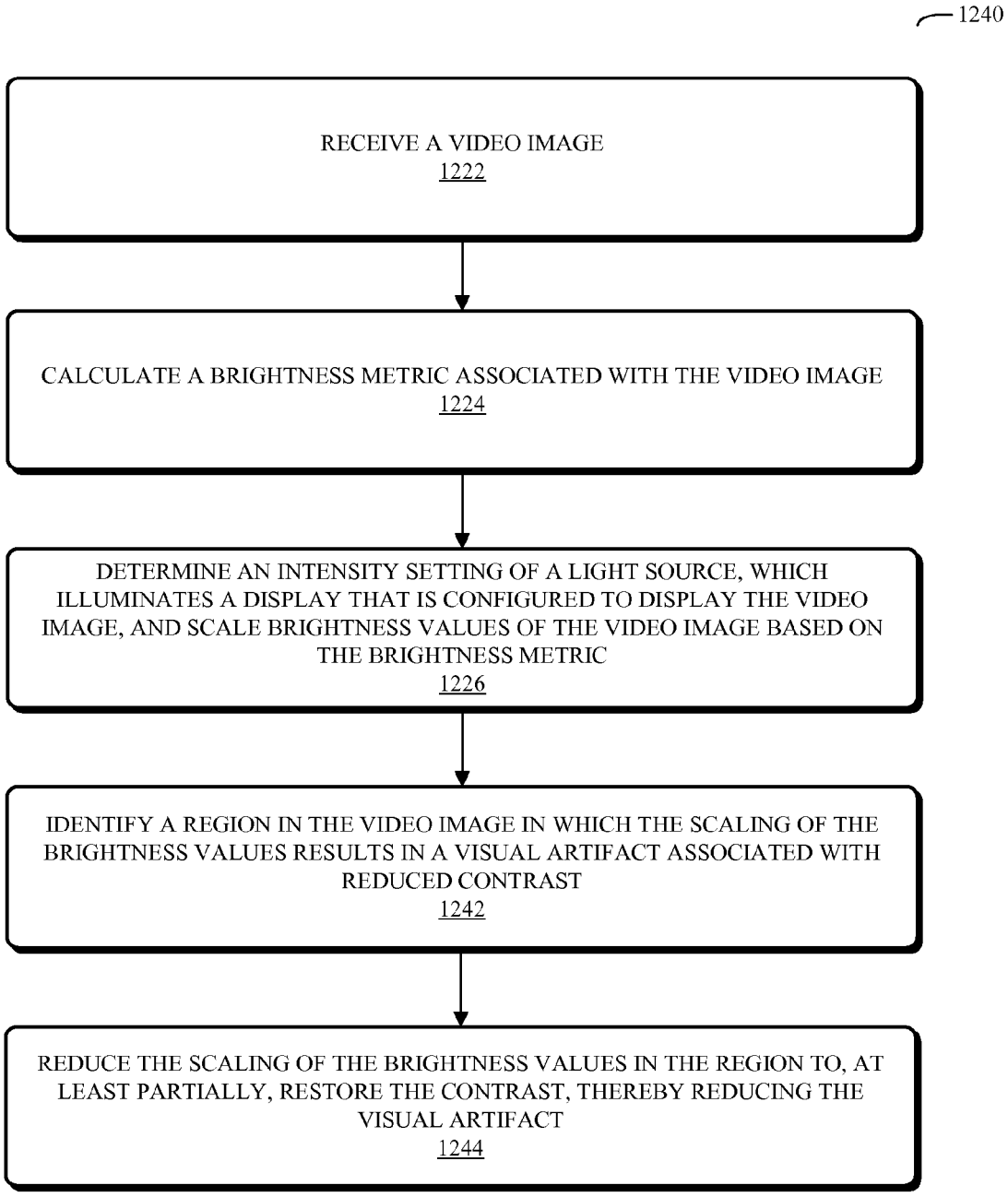
FIG. 12E is a flowchart illustrating a process for adjusting a brightness of pixels in a video image in accordance with an embodiment of the present invention.

FIG. 12E presents a flowchart illustrating a process 1240 for adjusting a brightness of pixels in a video image, which may be performed by a system. During operation, this system receives a video image (1222) and calculates a brightness metric associated with the video image (1224). Next, the system determines an intensity setting of a light source, which illuminates a display that is configured to display the video image, and scale brightness values of the video image based on the brightness metric (1226). Moreover, the system identifies a region in the video image in which the scaling of the brightness values results in a visual artifact associated with reduced contrast (1242). Then, the system reduces the scaling of the brightness values in the region to, at least partially, restore the contrast, thereby reducing the visual artifact (1244).

Figure 12F:
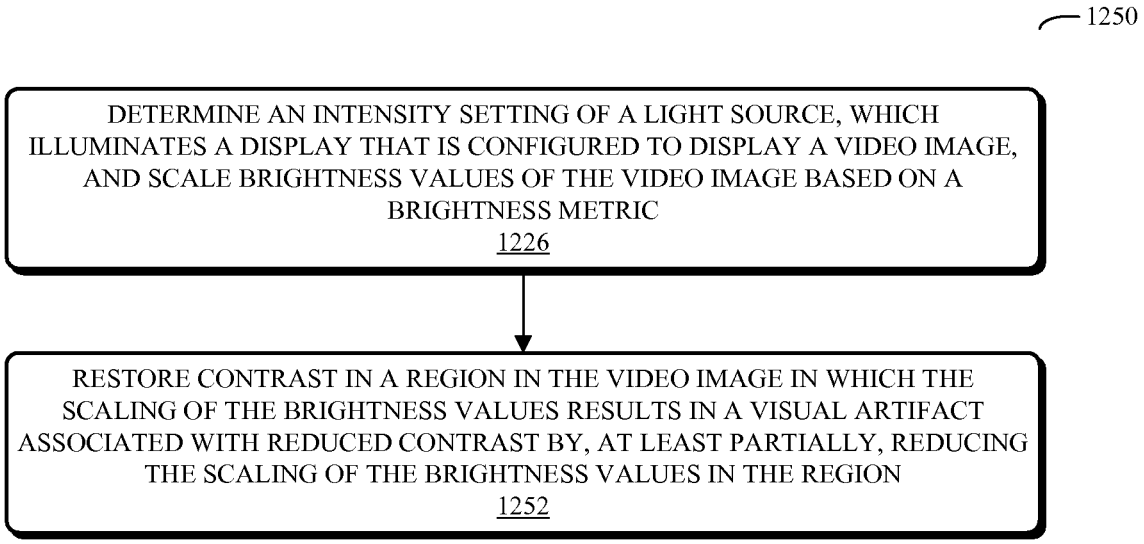
FIG. 12F is a flowchart illustrating a process for adjusting a brightness of pixels in a video image in accordance with an embodiment of the present invention.

FIG. 12F presents a flowchart illustrating a process 1250 for adjusting a brightness of pixels in a video image, which may be performed by a system. During operation, this system determines an intensity setting of a light source, which illuminates a display that is configured to display a video image, and scales brightness values for the video image based on a brightness metric associated with the video image (1226). Next, the system restores contrast in a region in the video image in which the scaling of the brightness values results in a visual artifact associated with reduced contrast by, at least partially, reducing the scaling of the brightness values in the region (1252).

Note that in some embodiments of the processes in FIGS. 11A-E and FIGS. 12A-F there may be additional or fewer operations. Moreover, the order of the operations may be changed and/or two or more operations may be combined into a single operation.

Figure 13:
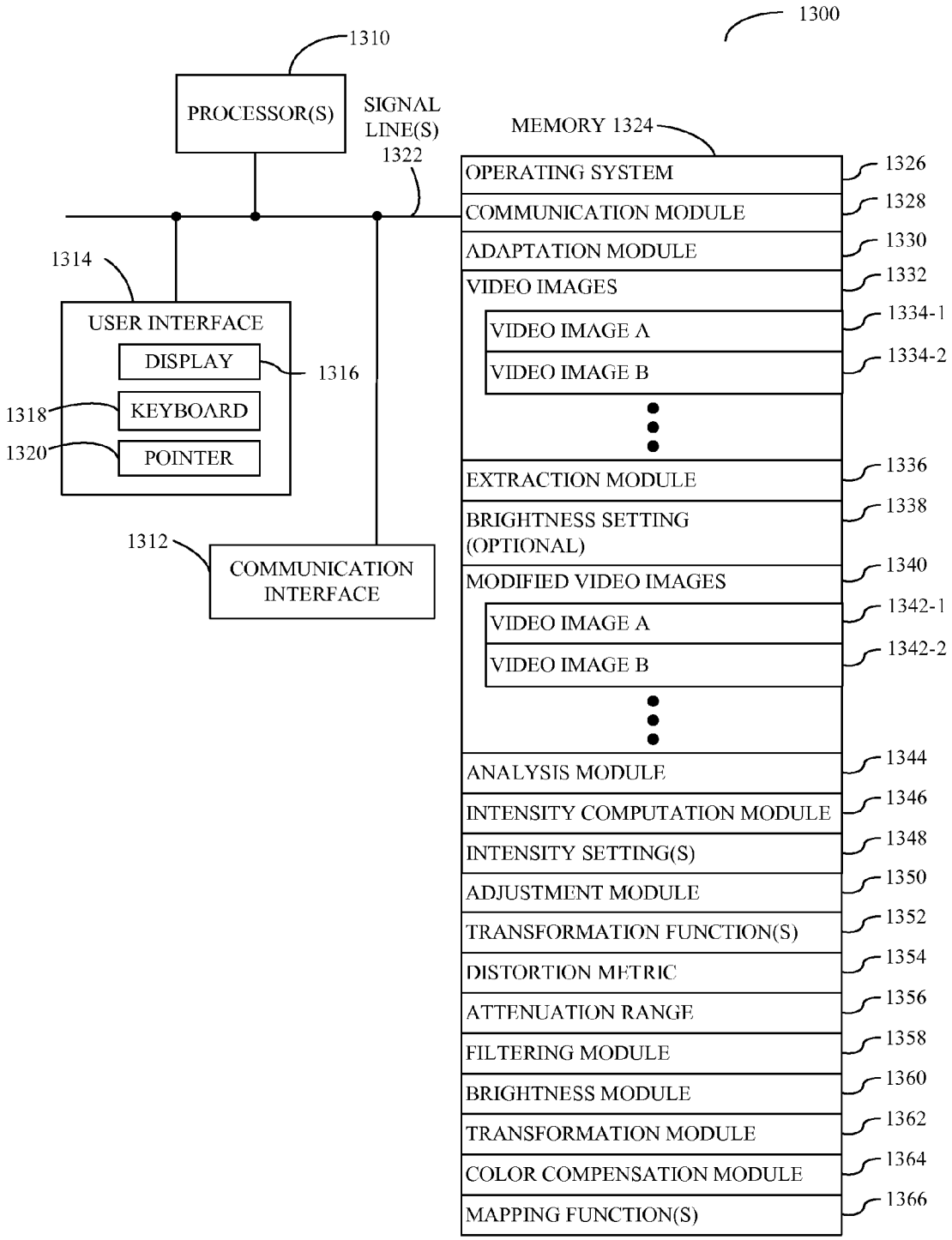
FIG. 13 is a block diagram illustrating a computer system in accordance with an embodiment of the present invention.

Computer systems for implementing these techniques in accordance with embodiments of the invention are now described. FIG. 13 presents a block diagram illustrating an embodiment of a computer system 1300. Computer system 1300 can include: one or more processors 1310, a communication interface 1312, a user interface 1314, and one or more signal lines 1322 electrically coupling these components together. Note that the one or more processing units 1310 may support parallel processing and/or multi-threaded operation, the communication interface 1312 may have a persistent communication connection, and the one or more signal lines 1322 may constitute a communication bus. Moreover, the user interface 1314 may include: a display 1316, a keyboard 1318, and/or a pointer 1320, such as a mouse. Memory 1324 in the computer system 1300 may include volatile memory and/or non-volatile memory. More specifically, memory 1324 may include: ROM, RAM, EPROM, EEPROM, FLASH, one or more smart cards, one or more magnetic disc storage devices, and/or one or more optical storage devices.

Memory 1324 may store an operating system 1326 that includes procedures (or a set of instructions) for handling various basic system services for performing hardware dependent tasks. Memory 1324 may also store communication procedures (or a set of instructions) in a communication module 1328. These communication procedures may be used for communicating with one or more computers and/or servers, including computers and/or servers that are remotely located with respect to the computer system 1300.

Memory 1324 may include multiple program modules (or a set of instructions), including: adaptation module 1330 (or a set of instructions), extraction module 1336 (or a set of instructions), analysis module 1344 (or a set of instructions), intensity computation module 1346 (or a set of instructions), adjustment module 1350 (or a set of instructions), filtering module 1358 (or a set of instructions), brightness module 1360 (or a set of instructions), transformation module 1362 (or a set of instructions), and/or color compensation module 1364 (or a set of instructions). Adaptation module 1330 may oversee the determination of intensity setting(s) 1348.

In particular, extraction module 1336 may calculate one or more brightness metrics (not shown) based on one or more video images 1332 (such as video image A 1334-1 and/or video image B 1334-2) and analysis module 1344 may identify one or more subsets of one or more of the video images 1332. Then, adjustment module 1350 may determine and/or use one or more mapping function(s) 1366 to scale one or more of the video images 1332 to produce one or more modified video images 1340 (such as video image A 1342-1 and/or video image B 1342-2). Note that the one or more mapping function(s) 1366 may be based, at least in part, on distortion metric 1354 and/or attenuation range 1356 of an attenuation mechanism in or associated with display 1316.

Based on the modified video images 1340 (or equivalently, based on one or more of the mapping functions 1366) and optional brightness setting 1338, intensity computation module 1346 may determine the intensity setting(s) 1348. Moreover, filtering module 1358 may filter changes in the intensity setting(s) 1348 and brightness module 1360 may adjust the brightness of a non-picture portion of the one or more video images 1332 or a portion of the one or more video images 1332 in which brightness values are less than a threshold.

In some embodiments, transformation module 1362 converts one or more video images 1332 to a linear brightness domain using one of the transformation functions 1352 prior to the scaling or the determination of the intensity setting(s) 1348. Moreover, after these computations have been performed, transformation module 1362 may convert one or more modified video images 1340 back to an initial (non-linear) or another brightness domain using another of the transformation functions 1352. In some embodiments, a given transformation function in the transformation functions 1352 includes an offset, associated with light leakage in the display 1316, that scale an arbitrary dark region in one of more video images 1332 to reduce or eliminate noise associated with modulation of a light source (such as a backlight).

Additionally, in some embodiments color adjustment module 1364 compensates for a dependence of a spectrum of a light source, which illuminates the display 1316, on the intensity settings 1348 by adjusting the color content in one or more modified video images 1340. Moreover, in embodiments where the display 1316 includes pixels associated with a white color filter and pixels associated with one or more additional color filters, extraction module 1336 may determine a saturated portion of one or more video images 1332. Then, adjustment module 1350 may selectively adjust pixels associated with the white color filter in one or more video images 1332.

Instructions in the various modules in the memory 1324 may be implemented in a high-level procedural language, an object-oriented programming language, and/or in an assembly or machine language. The programming language may be compiled or interpreted, e.g., configurable or configured to be executed by the one or more processing units 1310. Consequently, the instructions may include high-level code in a program module and/or low-level code, which is executed by the processor 1310 in the computer system 1300.

Although the computer system 1300 is illustrated as having a number of discrete components, FIG. 13 is intended to provide a functional description of the various features that may be present in the computer system 1300 rather than as a structural schematic of the embodiments described herein. In practice, and as recognized by those of ordinary skill in the art, the functions of the computer system 1300 may be distributed over a large number of servers or computers, with various groups of the servers or computers performing particular subsets of the functions. In some embodiments, some or all of the functionality of the computer system 1300 may be implemented in one or more ASICs and/or one or more digital signal processors DSPs.

Computer system 1300 may include fewer components or additional components. Moreover, two or more components can be combined into a single component and/or a position of one or more components can be changed. In some embodiments the functionality of the computer system 1300 may be implemented more in hardware and less in software, or less in hardware and more in software, as is known in the art.

Figure 14:
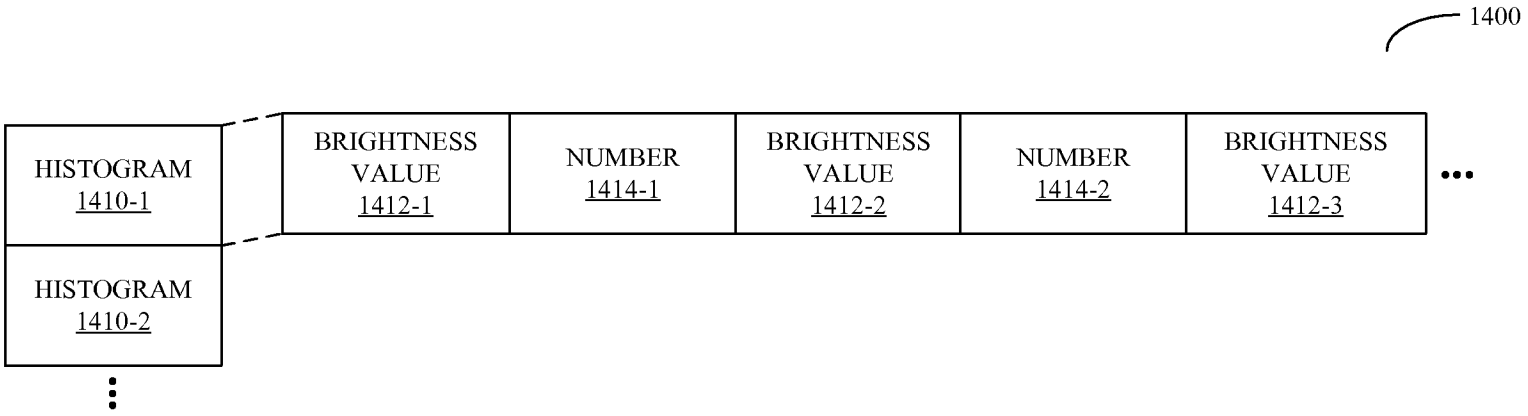
FIG. 14 is a block diagram illustrating a data structure in accordance with an embodiment of the present invention.

Data structures that may be used in the computer system 1300 in accordance with embodiments of the invention are now described. FIG. 14 presents a block diagram illustrating an embodiment of a data structure 1400. This data structure may include information for one or more histograms 1410 of brightness values. A given histogram, such as histogram 1410-1, may include multiple numbers 1414 of counts and associated brightness values 1412.

Figure 15:
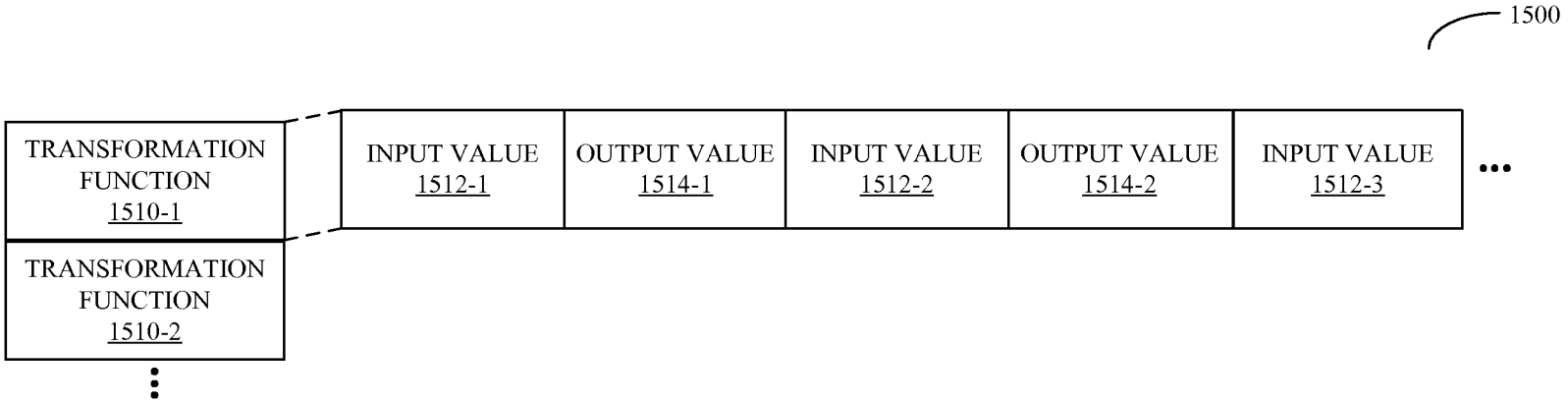
FIG. 15 is a block diagram illustrating a data structure in accordance with an embodiment of the present invention.

FIG. 15 presents a block diagram illustrating an embodiment of a data structure 1500. This data structure may include transformation functions 1510. A given transformation function, such as transformation function 1510-1, may include multiple pairs of input values 1512 and output values 1514, such as input value 1512-1 and output value 1514-1. This transformation function may be used to transform the video image from an initial brightness domain to a linear brightness domain and/or from the linear brightness domain to another brightness domain.

Note that that in some embodiments of the data structures 1400 (FIG. 14) and/or 1500 there may be fewer or additional components. Moreover, two or more components can be combined into a single component and/or a position of one or more components can be changed.

While brightness has been used as an illustration in many of the preceding embodiments, in other embodiments these techniques are applied to one or more additional components of the video image, such as one or more color components.

Embodiments of a technique for dynamically adapting the illumination intensity provided by a light source (such as an LED or a fluorescent lamp) that illuminates a display and/or for adjusting video images (such as one or more frames of video) to be displayed on the display are described. These embodiments may be implemented by a system.

In some embodiments of the technique, the system transforms a video image (for example, using a transform circuit) from an initial brightness domain to a linear brightness domain, which includes a range of brightness values corresponding to substantially equidistant adjacent radiant-power values in a displayed video image. In this linear brightness domain, the system may determine an intensity setting of the light source (for example, using a computation circuit) based on at least a portion of the transformed video image, such as the portion of the transformed video image that includes spatially varying visual information. Moreover, the system may modify the transformed video image (for example, using the computation circuit) so that a product of the intensity setting and a transmittance associated with the modified video image approximately equals a product of a previous intensity setting and a transmittance associated with the video image. For example, the modification may include changing brightness values in the transformed video image.

In some embodiments, the transformation compensates for gamma correction in the video image. For example, the transformation may be based on characteristics of the video camera or the imaging device that captured the video image. Note that the system may determine the transformation using a look-up table.

After modifying the video image, the system may convert the modified video image to another brightness domain characterized by the range of brightness values corresponding to non-equidistant adjacent radiant-power values in a displayed video image. Note that the other brightness domain may be approximately the same as the initial brightness domain. Alternatively, the transformation to the other brightness domain may be based on characteristics of the display, such as a gamma correction associated with a given display, and the system may determine this conversion using a look-up table.

Moreover, the conversion to the other brightness domain may include a correction for an artifact in the display, which the system may selectively apply on a frame-by-frame basis. Note that the display artifact may include light leakage near minimum brightness in the display.

In some embodiments, the system performs the modification of the video image on a pixel-by-pixel basis. Moreover, the system may determine the intensity setting based on a histogram of brightness values in at least the portion of the transformed video image.

In other embodiments of the technique, the system adjusts brightness of pixels in the video image. These pixels may include dark regions in the video image (such as regions having brightness values less than a predetermined threshold). For example, the dark regions may include: one or more dark lines, one or more black bars, and/or non-picture portions of the video image. Note that the dark regions may be at an arbitrary location in the video image.

In particular, the system may scale (for example, using an transformation circuit) brightness of these pixels from initial brightness values to new brightness values (which are greater than the initial brightness values). For example, a difference between the new maximum brightness value and the initial maximum brightness value may be at least 1 candela per square meter. This scaling may reduce user-perceived changes in the video image associated with backlighting of the display that displays the video image (for example, it may provide headroom to allow noise associated with pulsing of a backlight to be attenuated).

In some embodiments, the scaling is, at least in part, implemented during a transformation from the initial brightness domain to the linear brightness domain. In these embodiments, the transformation compensates for gamma correction in the video image (such as one or more characteristics of the video camera or the imaging device that captured the video image) and light leakage at low brightness values in a given display that will display the video image. Note that the system may determine this transformation using a look-up table.

After modifying the video image, the system may convert or transform the modified video image to other brightness domain characterized by the range of brightness values corresponding to non-equidistant adjacent radiant-power values in a displayed video image. During this transformation, at least a portion of the scaling may be implemented. For example, this transformation may be based on characteristics of the display, such as a gamma correction associated with the given display and/or light leakage at low brightness values in the given display. Moreover, the system may determine this transformation or conversion using another look-up table.

Note that the system may perform the scaling of the brightness of the pixels on a pixel-by-pixel basis.

In other embodiments of the technique, the system applies a correction to maintain the color of a video image when the intensity setting of the light source is changed. After determining the intensity setting of the light source (for example, using the computation circuit) based on at least the portion of the video image, the system may modify brightness values of pixels in at least the portion of the video image (for example, using the adjustment circuit) to maintain the product of the intensity setting and the transmittance associated with the modified video image. Then, the system may adjust color content in the video image (for example, using the adjustment circuit) based on the intensity setting to maintain the color associated with the video image even as the spectrum associated with the light sources varies with the intensity setting.

Alternatively, prior to adjusting the color content, the system may jointly modify brightness values of pixels in at least the portion of the image and the intensity setting of the light source to maintain light output from a display while reducing power consumption by the light source.

This color adjustment may be based on a characteristic of the light source. Additionally, the color adjustment may maintain the color white. Moreover, the color white may be maintained to within approximately 100 K or 200 K of a corresponding black-body temperature associated with the color of the video image prior to changes in the intensity setting. For example, the color adjustment may include increasing a blue-color component in the video image when the intensity setting is reduced relative to a previous intensity setting and may include decreasing the blue-color component in the video image when the intensity setting is increased relative to the previous intensity setting.

In some embodiments, the color adjustment maintains a ratio of two color components in the video image and another ratio of two color components in the video image, where color content of the video image is represented using three color components. Moreover, the system may adjust the color so that a product of the color values associated with the video image and the spectrum results in an approximately unchanged grayscale for the video image.

Additionally, the system may determine the intensity setting after the video image is transformed from the initial brightness domain to the linear brightness domain. Moreover, after the color content is adjusted, the system may convert the video image to the other brightness domain.

Note that modification of the brightness of the pixels and/or the color adjustment may be performed on a pixel-by-pixel basis. Moreover, the system may modify the brightness based on a histogram of brightness values in the video image and/or the dynamic range of the mechanism that attenuates coupling of light from the light source to the display.

In another embodiment of the technique, the system performs adjustments based on a saturated portion of the video image that is to be displayed on the display. This display may include pixels associated with a white color filter and pixels associated with one or more additional color filters. After optionally determining a color saturation of at least the portion of the video image (for example, using the extraction circuit), the system may selectively adjust pixels in the video image associated with the white color filter (for example, using the adjustment circuit) based on the color saturation. Then, the system may change an intensity setting of the light source based on the selectively adjusted pixels. Moreover, the system may optionally adjust color content in the video image based on the intensity setting to maintain the color associated with the video image even as the spectrum associated with the light sources varies with the intensity setting. For example, the adjustment of the color content may correct for a dependence of a spectrum of the light source on the intensity setting.

Additionally, the system may modify brightness values of pixels in at least the portion of the video image to maintain the product of the intensity setting and the transmittance associated with the modified video image.

Note that the adjustment of the color content may be performed on a pixel-by-pixel basis.

In some embodiments, the system receives a sequence of video images, which include the video image, and analyzes changes in the sequence of video images. Next, the system predicts an increase in the intensity setting and incrementally applies the increase across at least a subset of the sequence of video images. For example, the sequence of video images may correspond to a webpage, and a given video image in the sequence of video images may correspond to a subset of the webpage. Moreover, the analyzed changes may include motion estimation between the video images in the sequence of video images.

As noted previously, the optional color adjustment may be based on a characteristic of the light source. Additionally, the color adjustment may maintain the color white. Moreover, the color white may be maintained to within approximately 100 K or 200 K of a corresponding black-body temperature associated with the color of the video image prior to changes in the intensity setting. For example, the color adjustment may include increasing a blue-color component in the video image when the intensity setting is reduced relative to the previous intensity setting and may include decreasing the blue-color component in the video image when the intensity setting is increased relative to the previous intensity setting.

In some embodiments, the color adjustment maintains the ratio of two color components in the video image and the other ratio of two color components in the video image, where color content of the video image is represented using three color components. Note that the system may adjust the color content in the video image based on the selectively adjusted pixels. Moreover, the system may adjust the color so that a product of the color values associated with the video image and the spectrum results in an approximately unchanged grayscale for the video image.

In another embodiment of the technique, the system applies changes to the intensity setting and scales the brightness values when there is a discontinuity in the brightness metrics (such as histograms of brightness values) between two adjacent video images in a sequence of video images. For example, the discontinuity may include a change in a maximum brightness value that exceeds a predetermined value. Note that the analysis circuit may determine the presence of the discontinuity.

In some embodiments, the system applies a portion of changes in the intensity setting and a corresponding portion of the scaling of the brightness values on video-image basis in the sequence of video images. Note that the portion may be selected such that differences between adjacent video images is less than a predetermined value unless there is the discontinuity in the brightness metrics, in which case, the portion is selected such that differences between adjacent video images is greater than a predetermined value. For example, the portion may be implemented via a temporal filter.

In some embodiments, a rate of change of the portion corresponds to a size of the discontinuity in the brightness metrics. For example, the rate of change may be larger when the discontinuity is larger.

In another embodiment of the technique, the system calculates an error metric for the video image based on the scaled brightness values and the video image (for example, the calculation may be performed by an analysis circuit). Moreover, this error metric may be determined on a pixel-by-pixel basis in the video image.

If the error metric exceeds a predetermined value, the system may reduce the scaling of the brightness values on a pixel-by-pixel basis and/or may reduce a change in the intensity setting, thereby reducing distortion when the video image is displayed. Moreover, the system may reduce the scaling of the brightness values in a region in the video image, in which contributions from each of the pixels to the error metric exceeds the predetermined value, if a size of the region exceeds another predetermined value.

Note that a contribution of a given pixel in the video image to the error metric may correspond to a ratio of brightness value after the scaling to an initial brightness value before the scaling.

In another embodiment of the technique, the system identifies a region in the video image in which the scaling of the brightness values results in a visual artifact associated with reduced contrast (for example, the region may be identified using an analysis circuit). Then, the system may reduce the scaling of the brightness values in the region to, at least partially, restore the contrast, thereby reducing the visual artifact (for example, an adjustment circuit may reduce the scaling). Moreover, the system may spatially filter the brightness values in the video image to reduce a spatial discontinuity between the brightness values of pixels within the region and the brightness values in a remainder of the video image.

Note that the region may correspond to pixels having brightness values exceeding a predetermined threshold, and brightness values of pixels in the video image surrounding the region may be less than the predetermined threshold. Additionally, the region may be identified based on a number of pixels having brightness values exceeding the predetermined threshold. For example, the number of pixels may correspond to 3, 10 or 20% of pixels in the video image.

Another embodiment provides a method for adjusting a video image, which may be implemented by a system. During operation, the system compensates for gamma correction in the video image to produce a linear relationship between brightness values and an associated brightness of the video image when displayed. Next, the system calculates an intensity setting of the light source based on at least a portion of the compensated video image, where the light source is configured to illuminate the display that is configured to display video images. Then, the system adjusts the compensated video image so that the product of the intensity setting and the transmittance associated with the adjusted video image approximately equals the product of the previous intensity setting and the transmittance associated with the video image.

Another embodiment provides another method for adjusting a brightness of pixels in a video image, which may be implemented by the system. During operation, the system compensates for gamma correction in the video image to produce a linear relationship between brightness values and an associated brightness of the video image when displayed, where the compensation includes an offset at minimum brightness that is associated with light leakage in a display that is configured to display video images. Next, the system calculates an intensity setting of the light source based on at least a portion of the compensated video image, where the light source is configured to illuminate the display. Then, the system adjusts the compensated video image so that the product of the intensity setting and the transmittance associated with the adjusted video image approximately equals the product of the previous intensity setting and the transmittance associated with the video image.

Another embodiment provides another method for adjusting a video image, which may be implemented by the system. During operation, the system receives a video image and determines an intensity setting of the light source based on at least a portion of the video image, where the light source is configured to illuminate the display that is configured to display video images. Next, the system modifies brightness values of pixels in at least the portion of the video image to maintain the product of the intensity setting and the transmittance associated with the modified video image. Then, the system adjusts color content in the video image based on the intensity setting to maintain the color associated with the video image even as the spectrum associated with the light sources varies with the intensity setting.

Another embodiment provides another method for adjusting a video image, which may be implemented by the system. During operation, the system receives the video image. Next, the system jointly modifies brightness values of pixels in at least a portion of the video image and an intensity setting of the light source to maintain light output from the display while reducing power consumption by the light source, where the light source is configured to illuminate the display that is configured to display video images. Then, the system adjusts color content in the video image to correct for a dependence of the spectrum of the light source on the intensity setting.

Another embodiment provides another method for adjusting a video image, which may be implemented by the system. During operation, the system receives a sequence of video images, which include a video image, and optionally analyzes the sequence of video images, including determining a color saturation of at least a portion of the video image. Next, the system predicts an increase in an intensity setting of a light source, which is configured to illuminate a display, when the video image is to be displayed based on the color saturation. Then, the system selectively adjusts pixels in the video image associated with a white color filter based on the color saturation, where the display configured to display the video image includes pixels associated with one or more additional color filters and pixels associated with the white color filter. In some embodiments, the system optionally determines the intensity setting of the light source based on the selectively adjusted pixels. Moreover, the system incrementally applies the increase in the intensity setting across at least a subset of the sequence of video images.

Another embodiment provides another method for adjusting a brightness of a video image, which may be implemented by the system. During operation, the system identifies a discontinuity in brightness metrics associated with adjacent video images, including a first video image and a second video image, in a sequence of video images. Next, the system determines a change in an intensity setting of a light source, which illuminates a display that is configured to display the sequence of video images, and scales brightness values of the second video image based on a brightness metric associated with the second video image. Then, the system applies the change in the intensity setting and scales the brightness values.

Another embodiment provides another method for adjusting a brightness of a video image, which may be implemented by the system. During operation, the system receives a sequence of video images and calculates brightness metrics associated with the video images in the sequence of video images. Next, the system determines an intensity setting of a light source, which illuminates a display that is configured to display the sequence of video images, and scales brightness values of a given video image in the sequence of video images based on a given brightness metric associated with the given video image. Then, the system changes the intensity setting and scales the brightness values when there is a discontinuity in the brightness metrics between two adjacent video images in the sequence of video images.

Another embodiment provides another method for calculating an error metric associated with a video image, which may be implemented by the system. During operation, the system receives a video image and calculates a brightness metric associated with the video image. Next, the system determines an intensity setting of a light source, which illuminates a display that is configured to display the video image, and scales brightness values of the video image based on the brightness metric. Then, the system calculates an error metric for the video image based on the scaled brightness values and the received video image.

Another embodiment provides another method for calculating an error metric associated with a video image, which may be implemented by the system. During operation, the system reduces power consumption by changing an intensity setting of a light source, which illuminates a display that is configured to display a video image, and scaling brightness values for the video image based on a brightness metric associated with the video image. Next, the system calculates the error metric for the video image based on the scaled brightness values and the video image.

Another embodiment provides another method for adjusting a brightness of pixels in a video image, which may be implemented by the system. During operation, the system receives a video image and calculates a brightness metric associated with the video image. Next, the system determines an intensity setting of a light source, which illuminates a display that is configured to display the video image, and scale brightness values of the video image based on the brightness metric. Moreover, the system identifies a region in the video image in which the scaling of the brightness values results in a visual artifact associated with reduced contrast. Then, the system reduces the scaling of the brightness values in the region to, at least partially, restore the contrast, thereby reducing the visual artifact.

Another embodiment provides yet another method for adjusting a brightness of pixels in a video image, which may be implemented by the system. During operation, the system determines an intensity setting of a light source, which illuminates a display that is configured to display a video image, and scales brightness values for the video image based on a brightness metric associated with the video image. Next, the system restores contrast in a region in the video image in which the scaling of the brightness values results in a visual artifact associated with reduced contrast by, at least partially, reducing the scaling of the brightness values in the region.

Another embodiment provides one or more integrated circuits that implement one or more of the above-described embodiments.

Another embodiment provides a portable device. This device may include the display, the light source and the attenuation mechanism. Moreover, the portable device may include the one or more integrated circuits.

Another embodiment provides a computer-program product for use in conjunction with a system. This computer-program product may include instructions corresponding to at least some of the operations in the above-described methods.

Another embodiment provides a computer system. This computer system may execute instructions corresponding to at least some of the operations in the above-described methods. Moreover, these instructions may include high-level code in a program module and/or low-level code that is executed by a processor in the computer system.

The foregoing descriptions of embodiments of the present invention have been presented for purposes of illustration and description only. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A system, comprising one or more integrated circuits, wherein the one or more integrated circuits are configured to:

transform a video image from an initial brightness domain to a linear brightness domain, the linear brightness domain characterized by a range of brightness values corresponding to substantially equidistant adjacent radiant-power values in a displayed video image, wherein the transformation compensates for gamma correction in the video image which is introduced by an imaging device that captured the video image;

determine an intensity setting of a light source based on at least a portion of the transformed video image, the light source configured to illuminate a display that is configured to display video images; and modify the transformed video image so that a product of the intensity setting and a transmittance of the modified video image approximately equals a product of a previous intensity setting and a transmittance of the video image.

2. The system of claim 1, wherein the transformation is determined using a look-up table.

3. The system of claim 1, wherein the one or more integrated circuits are further configured to convert the modified video image to another brightness domain characterized by the range of brightness values corresponding to non-equidistant adjacent radiant-power values in a displayed video image.

4. The system of claim 3, wherein the other brightness domain is approximately the same as the initial brightness domain.

5. The system of claim 4, wherein the conversion applies a gamma correction to the modified video image.

6. The system of claim 5, wherein the gamma correction is associated with the display.

7. The system of claim 4, wherein the conversion is determined using a look-up table.

8. The system of claim 1, wherein the modification of the video image is performed on a pixel-by-pixel basis.

9. The system of claim 1, wherein the video image includes a frame of video.

10. The system of claim 1, wherein at least the portion of the transformed video image includes spatially varying visual information in the video image.

11. The system of claim 1, wherein the intensity setting is determined based on a histogram of brightness values in at least the portion of the transformed video image.

12. The system of claim 1, wherein the light source comprises a light-emitting diode or a fluorescent lamp.

13. The system of claim 1, wherein the modification includes changing brightness values in the transformed video image.

14. A system, comprising:

transform logic configured to transform a video image from an initial brightness domain to a linear brightness domain that is characterized by a range of brightness values corresponding to substantially equidistant adjacent radiant-power values in a displayed video image, wherein the transformation compensates for gamma correction in the video image introduced by an imaging device that captured the video image; and computation circuit logic coupled to the transform logic, the computation logic configured to determine an intensity setting of a light source, which is configured to illuminate a display that is configured to display video images, based on at least a portion of the transformed video image and configured to modify the transformed video image so that a product of the intensity setting and a transmittance of the modified video image approximately equals a product of a previous intensity setting and a transmittance of the video image.

15. A method for adjusting a video image, comprising:

compensating for gamma correction in a video image to produce a linear relationship between brightness values and an associated brightness of the video image when displayed, wherein compensating for gamma correction in the video image comprises compensating for gamma correction introduced by an imaging device that captured the video image;

calculating an intensity setting of a light source based on at least a portion of the compensated video image, the light source configured to illuminate a display that is configured to display video images; and adjusting the compensated video image so that a product of the intensity setting and a transmittance of the adjusted video image approximately equals a product of a previous intensity setting and a transmittance of the video image.

16. A non-transitory computer-program product for use in conjunction with a computer system, the computer-program product comprising a computer-readable storage medium and a computer-program mechanism embedded therein for adjusting a video image, the computer-program mechanism comprising:

instructions to compensate for gamma correction in a video image to produce a linear relationship between brightness values and an associated brightness of the video image when displayed, wherein compensating for gamma correction in the video image comprises compensating for gamma correction introduced by an imaging device that captured the video image;

instructions to calculate an intensity setting of a light source based on at least a portion of the compensated video image, the light source configured to illuminate a display that is configured to display video images; and instructions to adjust the compensated video image so that a product of the intensity setting and a transmittance of the adjusted video image approximately equals a product of a previous intensity setting and a transmittance of the video image.

17. A computer system to adjust a video image, comprising:

a processor;

memory;

a program module, wherein the program module is stored in the memory and configurable to be executed by the processor, the program module including:

instructions to compensate for gamma correction in a video image to produce a linear relationship between brightness values and an associated brightness of the video image when displayed, wherein compensating for gamma correction in the video image comprises compensating for gamma correction introduced by an imaging device that captured the video image;

instructions to calculate an intensity setting of a light source based on at least a portion of the compensated video image, the light source configured to illuminate a display that is configured to display video images; and instructions to adjust the compensated video image so that a product of the intensity setting and a transmittance of the adjusted video image approximately equals a product of a previous intensity setting and a transmittance of the video image.

18. A computer system configured to adjust a video image, comprising:

a processor;

a memory;

an instruction fetch unit within the processor configured to fetch:

instructions to compensate for gamma correction in a video image to produce a linear relationship between brightness values and an associated brightness of the video image when displayed, wherein compensating for gamma correction in the video image comprises compensating for gamma correction introduced by an imaging device that captured the video image;

instructions to calculate an intensity setting of a light source based on at least a portion of the compensated video image, the light source configured to illuminate a display that is configured to display video images; and instructions to adjust the compensated video image so that a product of the intensity setting and a transmittance of the adjusted video image approximately equals a product of a previous intensity setting and a transmittance of the video image.

19. An integrated circuit, comprising one or more sub-circuits, wherein the one or more sub-circuits are configured to:

transform a video image from an initial brightness domain to a linear brightness domain, the linear brightness domain characterized by a range of brightness values corresponding to substantially equidistant adjacent radiant-power values in a displayed video image, wherein the transformation compensates for gamma correction in the video image which is introduced by an imaging device that captured the video image;

determine an intensity setting of a light source based on at least a portion of the transformed video image, the light source configured to illuminate a display that is configured to display video images; and modify the transformed video image so that a product of the intensity setting and a transmittance of the modified video image approximately equals a product of a previous intensity setting and a transmittance of the video image.

20. A portable device, comprising:

a display;

a light source configured to output light;

an attenuation mechanism configured to modulate the output light incident on the display, the display configured to display a video image; and one or more integrated circuits, wherein the one or more integrated circuits are configured to:

transform the video image from an initial brightness domain to a linear brightness domain, the linear brightness domain characterized by a range of brightness values corresponding to substantially equidistant adjacent radiant-power values in a displayed video image, wherein the transformation compensates for gamma correction in the video image which is introduced by an imaging device that captured the video image;

determine an intensity setting of a light source based on at least a portion of the transformed video image, the light source configured to illuminate a display that is configured to display video images; and modify the transformed video image so that a product of the intensity setting and a transmittance of the modified video image approximately equals a product of a previous intensity setting and a transmittance of the video image.

* * * * *

UNITED STATES PATENT AND TRADEMARK OFFICE

CERTIFICATE OF CORRECTION

PATENT NO. : 8,692,755 B2
APPLICATION NO. : 12/145176
DATED : April 8, 2014
INVENTOR(S) : Ulrich T. Barnhoefer et al.

It is certified that error appears in the above-identified patent and that said Letters Patent is hereby corrected as shown below:

In the Claims

In Column 37, line 65, claim 14, please delete the word "circuit".

Signed and Sealed this
Thirtieth Day of September, 2014

Michelle K. Lee

Michelle K. Lee
*Deputy Director of the United States Patent and Trademark Office*